US006385410B1

(12) United States Patent
Hanyu et al.

(10) Patent No.: US 6,385,410 B1
(45) Date of Patent: May 7, 2002

(54) FIXING APPARATUS USING A THIN-SLEEVE ROLLER WHICH ACHIEVES A GOOD FIXING RESULT WHILE SUPPRESSING ELECTRIC POWER CONSUMPTION

(75) Inventors: Naohiko Hanyu; Shinsuke Fujita; Mitsugu Nemoto, all of Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/624,970

(22) Filed: Jul. 24, 2000

(30) Foreign Application Priority Data

Jul. 30, 1999 (JP) ..... 11-216168
Jul. 30, 1999 (JP) ..... 11-216169

(51) Int. Cl.[7] ..... G03G 15/20
(52) U.S. Cl. ..... 399/68; 399/337
(58) Field of Search ..... 399/68, 330, 331, 399/334, 337

(56) References Cited

U.S. PATENT DOCUMENTS 4,301,359 A * 11/1981 Ito et al. ..... 399/334 X
4,595,279 A * 6/1986 Kuru et al. ..... 399/68 X
4,618,240 A * 10/1986 Sakurai et al. ..... 399/334 X
5,170,215 A * 12/1992 Pfeuffer ..... 399/68
5,289,247 A * 2/1994 Takano et al. ..... 399/68
5,561,512 A * 10/1996 Fukano et al. ..... 399/68 X
5,621,512 A * 4/1997 Uehara et al. ..... 399/330 X
5,819,134 A * 10/1998 Sato et al. ..... 399/330 X
5,862,436 A * 1/1999 Ishizawa et al. ..... 399/334 X
5,998,761 A * 12/1999 Berkes et al. ..... 399/68 X

* cited by examiner

*Primary Examiner*—Fred L Braun
(74) *Attorney, Agent, or Firm*—Frishauf, Holtz, Goodman, Langer & Chick, P.C.

(57) ABSTRACT

A fixing apparatus using a thin-sleeve roller is provided which gives a good fixing result while suppressing electric power consumption. The fixing apparatus includes a hollow cylindrical heating roller, a heat source positioned inside the heating roller, a pressing roller that is in pressure contact with the heating roller to form a nip between the heating roller and the pressing roller, and a controller that controls a conveyance velocity of the transfer material. The heating roller is divided into a first regions and a second region, with the first region being outside the second region. And the heat source includes a first heating section that mainly heats the first region, and a second heating section that mainly heats the second region. A heat distribution ratio of the first heating section is set so that a heat quantity at the second region is in a range of 15%–70% of a heat quantity at the first region, and/or a heat distribution ratio of the second heating section is set so that the heat quantity at the first region is lower than 60% of the heat quantity at the second region.

14 Claims, 17 Drawing Sheets

FIG. 12 ( a )
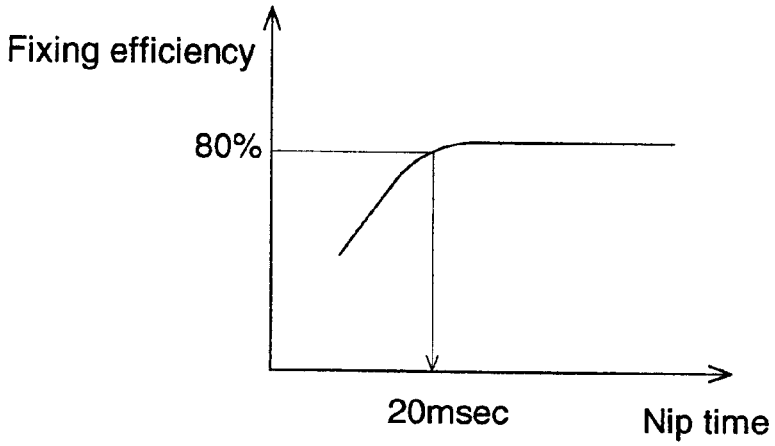
FIG. 12 ( b )
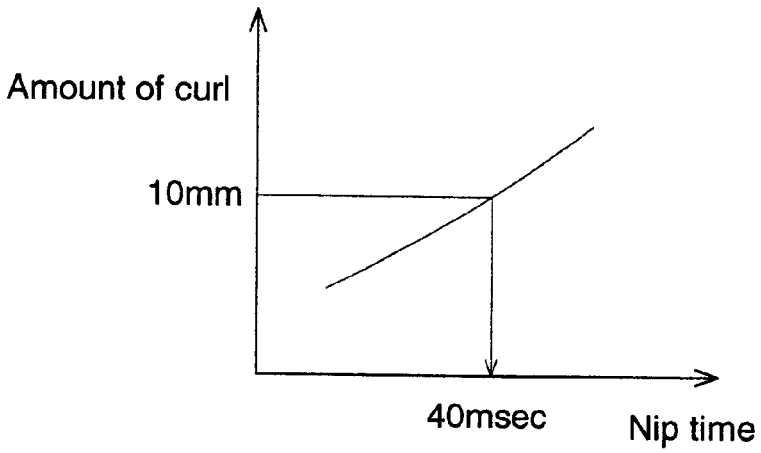

FIXING APPARATUS USING A THIN-SLEEVE ROLLER WHICH ACHIEVES A GOOD FIXING RESULT WHILE SUPPRESSING ELECTRIC POWER CONSUMPTION

BACKGROUND OF THE INVENTION

This invention relates to a fixing apparatus which has a heating roller having a heating means inside and a pressing roller being in pressure contact with said heating roller, and makes a transfer material having a toner image transferred on it pass between the above-described heating roller and pressing roller to thermally fix said toner image to said transfer material.

At present, a fixing apparatus of the heat roller type which is used in an image forming apparatus such as a copying machine and a laser beam printer is composed of a heating roller having a halogen heater lamp as a heat source inside and being provided with a coating layer for a better releasing ability, and a pressing roller having a surface layer made of a rubber material.

Incidentally, in an image forming apparatus having a fixing apparatus of the above-described structure, two thirds of the electric power is consumed in the fixing apparatus during image formation.

Further, in order to make it possible to form an image whenever it is required, the heating roller of the fixing apparatus is always kept at a predetermined temperature even in standby hours, and two thirds of the electric power of the standby hours also is consumed in the fixing apparatus.

Incidentally, the electric power consumption of a fixing apparatus during the formation of an image is approximately determined by the product of the heat quantity which is necessary for fixing a sheet of transfer material times the number of sheets having an image formed.

In an image forming apparatus of a class with an image forming speed of 20–30 sheets per minute, the heat quantity required for a unit time is small in proportion to the slow speed of image forming, and it is not necessary to store heat in the heating roller; thus, sufficient heat can be supplied at the time of image forming.

Accordingly, from the point of view to save energy, it has been proposed a heating roller having its heat capacity made small by making the thickness of its metallic sleeve as thin as possible.

However, if a heating roller with a thin sleeve is used, there are problems as follows:.

(1) Because the heat capacity of the heating roller is small, the difference between the required heat quantity during fixing and that in idling hours is large.

Accordingly, in the case where a control, in which the supply of electric current to the heating means is turned on and off at a set temperature, is carried out for the temperature control of the heating roller, when fixing is finished and the driving for the rotation of the heating roller is stopped, if the heating means is still actuated, the heat quantity immediately after the stop becomes excessive because of the large supplied heat quantity before and after the stop of rotation of the heating roller; hence, the temperature of the heating roller becomes abnormally higher than the set temperature owing to the overshoot, which results in a useless consumption of electric power.

(2) In the case where a large number of sheets of transfer material having a small width are continuously fixed, only a part of the heating roller (for example, only the central portion of the heating roller) requires heat.

Especially, in the case where plural sheets of transfer material, like sheets of 5.5×8.5R, having a proportion of the smallest width and a larger length in the flow direction than the sheets of transfer material of A-sizes and B-sizes are continuously fixed, there is also a problem that it occurs that unnecessary area is heated, and the temperature rise of the portion with which no paper sheet comes in contact becomes remarkable in accordance with the small heat capacity of the heating roller, which makes the temperature control difficult.

(3) In the case where a control, in which the supply of electric current to the heating means is turned on and off at a set temperature, is carried out for the temperature control of the heating roller, because the heat capacity of the heating roller is small, the temperature of the heating roller rises and drops with respect to the set temperature, and the frequency of turning on and off of the current supply becomes high.

There is also a problem that, when the heating means is turned on, a noise is produced owing to a rush current.

SUMMARY OF THE INVENTION

Heretofore, it has been known that, in order to suppress the electric power consumption of a fixing apparatus, the sleeve of its heating roller is made thin, as is disclosed in the publications of Tokkaihei H7-64420 and Tokkaihei H9-297486. However, in order to obtain a good fixing result through using a thin-sleeve roller, it is necessary to use an optimum fixing condition which is suitable to it, and if a fixing condition which is the same as that used for a conventional thick-sleeve roller was used, a good fixing result could not be obtained. Therefore, it is an object of this invention to provide a fixing apparatus which gives a good fixing result while suppressing electric power consumption by using a thin-sleeve roller.

It is the second object of the invention to provide a fixing apparatus which eliminates a useless electric power consumption at the time of completion of fixing.

It is the third object of the invention to provide a fixing apparatus which is capable of making a temperature control with a high precision in the case where plural sheets of transfer material having a small width are continuously fixed.

It is the fourth object of the invention to provide a fixing apparatus which reduces the generation of noise.

Accordingly, to overcome the cited shortcomings, the abovementioned objects of the present invention can be attained by a fixing apparatus and an image forming apparatus described as follow.

(1) A fixing apparatus for fixing a toner image onto a transfer material, comprising a heating roller being a hollow cylinder, thickness of which is less than 2.0 mm, made of either aluminum or iron, a heat source positioned interior of the heating roller, a pressing roller, comprised of a silicone rubber having a surface hardness ranging from 35° to 75° (Asker C hardness), being in pressure contact with the heating roller to form a nip between the heating roller and the pressing roller, wherein a nip pressure at the nip is in a range of 0.2–2.0 kgf/cm$^2$, and a controller to control a conveyance velocity of the transfer material, so that the transfer material passes through the nip within a nip passing time ranging from 20 msec to 40 msec.

(2) An image forming apparatus, comprising an image bearing element to form a latent image on it, a developing device to form a toner image on the image bearing element, a transferring device to transfer the toner image, formed by the developing device, onto a transfer material a fixing device to fix the toner image, transferred by the transferring device, onto the transfer material, the fixing device comprising, a heating roller being a hollow cylinder made of either aluminum or iron, thickness of which is less than 2.0 mm, a heat source positioned interior of the heating roller, and a pressing roller, comprised of a silicone rubber having a surface hardness ranging from 35° to 75° (Asker C hardness), being in pressure contact with the heating roller to form a nip between the heating roller and the pressing roller, wherein a nip pressure at the nip is in a range of 0.2–2.0 kgf/cm$^2$, and a controller to control a conveyance velocity of the transfer material, so that the transfer material passes through the nip within a nip passing time ranging from 20 msec to 40 msec.

Further, to overcome the abovementioned problems, other fixing apparatuses, embodied in the present invention, will be described as follows:

(3) A fixing apparatus which has a heating roller having a heat source inside and a pressing roller being in pressure contact with said heating roller, and makes a transfer material having a toner image transferred on it pass between the above-described heating roller and pressing roller to thermally fix said toner image to said transfer material, wherein said heating roller has a cylindrical sleeve made of either aluminum or iron and a thickness equal to or smaller than 2.0 mm, said pressing roller is made of a silicone rubber and has a surface hardness (Asker C hardness) of 35–75, the nip pressure between said heating roller and said pressing roller is 0.2–2.0 kgf/cm$^2$, and the passing time through the nip is 20–40 msec.

The electric power consumption of a fixing apparatus during the formation of an image is approximately determined by the product of the heat quantity which is necessary for fixing a sheet of transfer material times the number of sheets having an image formed.

In an image forming apparatus of a class with an image forming speed of 20–30 sheets per minute, the heat quantity required for a unit time is small in proportion to the slow speed of image forming, and it is not necessary to store heat in the heating roller; thus, sufficient heat can be supplied at the time of image forming.

Accordingly, it is desirable to make the sleeve of a heating roller as thin as possible.

By making the material of the sleeve of the heating roller either aluminum or iron and the thickness of the sleeve equal to or smaller than 2.0 mm, that is, by making it thin, the heat capacity of the heating roller is made small, which makes the thermal efficiency high.

Further, by making the material of the pressing roller a silicone rubber, its surface hardness (Asker C hardness) 35–75, the nip pressure between said heating roller and said pressing roller 0.2–2.0 kgf/cm$^2$, and the nip passing time 20–40 msec, that is, by making the pressing roller of a soft material, the nip time of a transfer material is made long, and the heat quantity to be supplied to the transfer material can be secured.

Besides, according to the result of experiments by the inventors of this application, it is confirmed that the thickness of the sleeve should desirably be 0.6–2.0 mm if the sleeve is made of aluminum, and 0.3–1.0 mm for iron.

(4) A fixing apparatus set forth in the above-described paragraph (2), wherein a first heating means for heating the area which is inside the area which a sheet of transfer material of the maximum size passes and is outside the area which a sheet of transfer material of a predetermined size passes, and a second heating means for heating the area which a sheet of transfer material of the predetermined size passes are provided in the aforesaid heating roller.

By providing a first heating means for heating the area which is inside the area which a sheet of transfer material of the maximum size passes and is outside the area which a sheet of transfer material of a predetermined size passes, and a second heating means for heating the area which a sheet of transfer material of the predetermined size passes, and independently controlling for driving the first heating means and the second heating means, even in the case where a sheet of transfer material having a size equal to or smaller than a predetermined size is fixed, it can be prevented the temperature rise of the portion which no sheet of paper comes in contact with and is inside the area which a sheet of transfer material of the maximum size passes and is outside the area which a sheet of transfer material of the predetermined size passes; thus, the useless area is not heated and the electric power consumption of the heating means is reduced.

(5) A fixing apparatus set forth in the above-described paragraph (4), wherein the heat distribution ratio in the aforesaid first heating means are equal to or larger than 15% for the area which a sheet of transfer material of the predetermined size passes on condition that it is 100% for the area outside the area which a sheet of transfer material of the predetermined size passes.

By making such a heat distribution ratio, by turning the first heating means on and off during idling, even if the second heating means is in the off-state, the temperature over the whole area of the heating roller can be kept approximately uniform.

Thus, the number of times of turning on and off of the heating means can be reduced, and the generation of a noise can be prevented.

(6) A fixing apparatus set forth in the above-described paragraph (4) or (5), wherein the heat distribution ratio in the aforesaid second heating means is equal to or smaller than 60% for the area outside the area which a sheet of transfer material of the predetermined size passes on condition that it is 100% for the area which a sheet of transfer material of the predetermined size passes.

By making such a heat distribution ratio, even when plural sheets of transfer material having a width smaller than the predetermined size are continuously fixed, the temperature of the heating roller can be kept at a predetermined temperature by only the second heating means.

(7) A fixing apparatus set forth in any one of the above-described paragraphs (4) to (6), wherein a first temperature detecting means for detecting the temperature of the area of the aforesaid heating roller which is inside the area which a sheet of transfer material of the maximum size passes and is outside the area which a sheet of the predetermined size passes, and a second temperature detecting means for detecting the temperature of the area of the said heating roller which a sheet of transfer material of the predetermined size passes are provided.

By providing a first temperature detecting means for detecting the temperature of the area of the aforesaid heating roller which is inside the area which a sheet of transfer material of the maximum size passes and is outside the area which a sheet of transfer material of the predetermined size passes, and a second temperature detecting means for detecting the temperature of the area of said heating roller which a sheet of transfer material of the predetermined size passes, a precise temperature control for the first heating means and the second heating means can be done, and the electric power consumption is reduced.

(8) A fixing apparatus set forth in any one of the above-described paragraphs (4) to (7), wherein a thermostat is provided in the neighborhood of the border of the aforesaid first heating means and the aforesaid second heating means of the heating roller.

In the case where the formation of an image is continuously carried out on a large number of sheets of transfer material having a width smaller than the predetermined size, the temperatures of the both side portions in the first heating means rise extremely; however, by providing a thermostat in the neighborhood of the border of the aforesaid first heating means and the aforesaid second heating means of the heating roller, it can be prevented that the heating roller reaches a temperature higher than the set temperature by cutting the supply of the electric power to the first heating means by the thermostat, and further, the electric power consumption is reduced.

(9) A fixing apparatus set forth in any one of the above-described paragraphs (5) to (7), wherein it is provided a cooling means for cooling the both side portions of the area of the heating roller which a sheet of transfer material of the predetermined size passes.

By providing a cooling means for cooling the both side portions of the area of the heating roller which a sheet of transfer material of the predetermined size passes, in the case where the formation of an image is carried out on sheets of transfer material having a width smaller than the predetermined size, when the temperatures of the both side portions in the second heating means rise extremely, it can be prevented by cooling the heating roller by the cooling means that the heating roller reaches a temperature higher than the set temperature.

(10) A fixing apparatus set forth in any one of the above-described paragraphs (3) to (8), wherein it is provided a cleaning mechanism having a web which is in contact with the aforesaid heating roller.

Because only the web having a small heat capacity of the cleaning mechanism is contact with the heating roller, the electric power consumption is small.

(11) A fixing apparatus which has a heating roller having a heating means inside and a pressing roller being in pressure contact with said heating roller, and makes a transfer material having a toner image transferred on it pass between the above-described heating roller and pressing roller to thermally fix said toner image to said transfer material, wherein said heating roller has a cylindrical sleeve made of either aluminum or iron and a thickness equal to or smaller than 2.0 mm, and a first heating means for heating the area which is inside the area which a sheet of transfer material of the maximum size passes and is outside the area which a sheet of transfer material of a predetermined size passes, and a second heating means for heating the area which a sheet of transfer material of the predetermined size passes are provided in the aforesaid heating roller.

The electric power consumption of a fixing apparatus during the formation of an image is approximately determined by the product of the heat quantity which is necessary for fixing a sheet of transfer material times the number of sheets having an image formed.

In an image forming apparatus of a class with an image forming speed of 20–30 sheets per minute, the heat quantity required for a unit time is small in proportion to the slow speed of image forming, and it is not necessary to store heat in the heating roller; thus, sufficient heat can be supplied at the time of image forming.

Accordingly, it is desirable to make the sleeve of a heating roller as thin as possible.

By making the material of the sleeve of the heating roller either aluminum or iron and the thickness of the sleeve equal to or smaller than 2.0 mm, that is, by making it thin, the heat capacity of the heating roller is made small, which makes the thermal efficiency high.

By providing a first heating means for heating the area which is inside the area which a sheet of transfer material of the maximum size passes and is outside the area which a sheet of transfer material of a predetermined size passes, and a second heating means for heating the area which a sheet of transfer material of the predetermined size passes, and independently controlling for driving the first heating means and the second heating means, even in the case where a sheet of transfer material having a size equal to or smaller than a predetermined size is fixed, it can be prevented the temperature rise of the portion which no sheet of paper comes in contact with and is inside the area which a sheet of transfer material of the maximum size passes and is outside the area which a sheet of transfer material of the predetermined size passes; thus, the useless area is not heated and the electric power consumption of the heating means is reduced.

(12) A fixing apparatus set forth in the above-described paragraph (11), wherein the heat distribution ratio in the aforesaid first heating means are equal to or larger than 15% for the area which a sheet of transfer material of the predetermined size passes on condition that it is 100% for the area outside the area which a sheet of transfer material of the predetermined size passes.

By making such a heat distribution ratio, by turning the first heating means on and off during idling, even if the second heating means is in the off-state, the temperature over the whole area of the heating roller can be kept approximately uniform.

Thus, the number of times of turning on and off of the heating means can be reduced, and the generation of a noise can be prevented.

(13) A fixing apparatus set forth in the above-described paragraph (11) or (12), wherein the heat distribution ratio in the aforesaid second heating means is equal to or smaller than 60% for the area outside the area which a sheet of transfer material of the predetermined size passes on condition that it is 100% for the area which a sheet of transfer material of the predetermined size passes.

By making such a heat distribution ratio, even when plural sheets of transfer material having a width smaller than the predetermined size are continuously fixed, the temperature of the heating roller can be kept at a predetermined temperature by only the second heating means.

(14) A fixing apparatus which has a heating roller having a heating means inside and a pressing roller being in pressure contact with said heating roller, and makes a transfer material having a toner image transferred on it pass between the above-described heating roller and pressing roller to thermally fix said toner image to said transfer material, wherein a control section is provided for forcibly stopping the driving of said heating means for a time, when fixing is completed and the driving for the rotation of said heating roller is stopped, and then, controls driving of said heating means during an idling state of said fixing apparatus.

Useless consumption of the electric power is eliminated by stopping the driving of the aforesaid heating means by the control section when fixing is completed and the driving for the rotation of said heating roller is stopped, since the overshoot of temperature of the heating roller can be suppressed.

(15) A fixing apparatus which has a heating roller having a heating means inside and a pressing roller being in pressure contact with said heating roller, and makes a transfer material having a toner image transferred on it pass between the above-described heating roller and pressing roller to thermally fix said toner image to said transfer material, wherein a first heating means provided in said heating roller for heating the area which is inside the area which a sheet of transfer material of the maximum size passes and is outside the area which a sheet of transfer material of a predetermined size passes, a second heating means provided in said heating roller for heating the area which a sheet of transfer material of the predetermined size passes are provided in the aforesaid heating roller, a first temperature detecting means for detecting the temperature of the area of said heating roller which is inside the area which a sheet of transfer material of the maximum size passes and is outside the area which a sheet of the predetermined size passes, and a second temperature detecting means for detecting the temperature of the area of said heating roller which a sheet of transfer material of the predetermined size passes, a cooling means for cooling the area of said heating roller which is outside the area which a sheet of transfer material of the predetermined size passes, and a control section for driving said cooling means in the case where a sheet of transfer material having a width smaller than the predetermined size is fixed, while lowering the set temperature of said first heating means and lowering the set temperature of said second heating means after a predetermined number of copies are provided.

In the case where sheets of transfer material having a width smaller than the predetermined size are fixed, by the control section driving the aforesaid cooling means while lowering the set temperature of said second heating means after a predetermined number of copies, it is made high the precision of the temperature control when sheets of transfer material having a narrow width are fixed.

(16) A fixing apparatus which has a thin-sleeve heating roller having a heating means inside and a pressing roller being in pressure contact with said heating roller, and makes a transfer material having a toner image transferred on it pass between the above-described heating roller and pressing roller to thermally fix said toner image to said transfer material, wherein a temperature detecting means for detecting the temperature of said heating roller and a control section which, during idling, stops said heating means when said heating roller reaches a temperature equal to or higher than a first set temperature, and drives said heating means when said heating roller has a temperature equal to or lower than a second set temperature which is lower than said first set temperature are provided.

During idling, by the control section stopping said heating means when said heating roller reaches a temperature equal to or higher than a first set temperature, and driving said heating means when said heating roller has a temperature equal to or lower than a second set temperature which is lower than said first set temperature, that is, by making a control having a hysteresis, the frequency of turning on and off of the heating means is reduced, and the generation of a noise is suppressed.

BRIEF DESCRIPTION OF THE DRAWINGS

Other objects and advantages of the present invention will become apparent upon reading the following detailed description and upon reference to the drawings in which:

FIG. 12(*a*) and 12(*b*) are drawings for explaining the relation between nip passing time and fixing efficiency and the relation between nip passing time and the amount of curl;

DETAILED DESCRIPTION OF THE PREFERRED EMBODIMENT

In the following, an example of the embodiment of this invention will be explained with reference to the drawings.

Overall Structure

Figure 10:
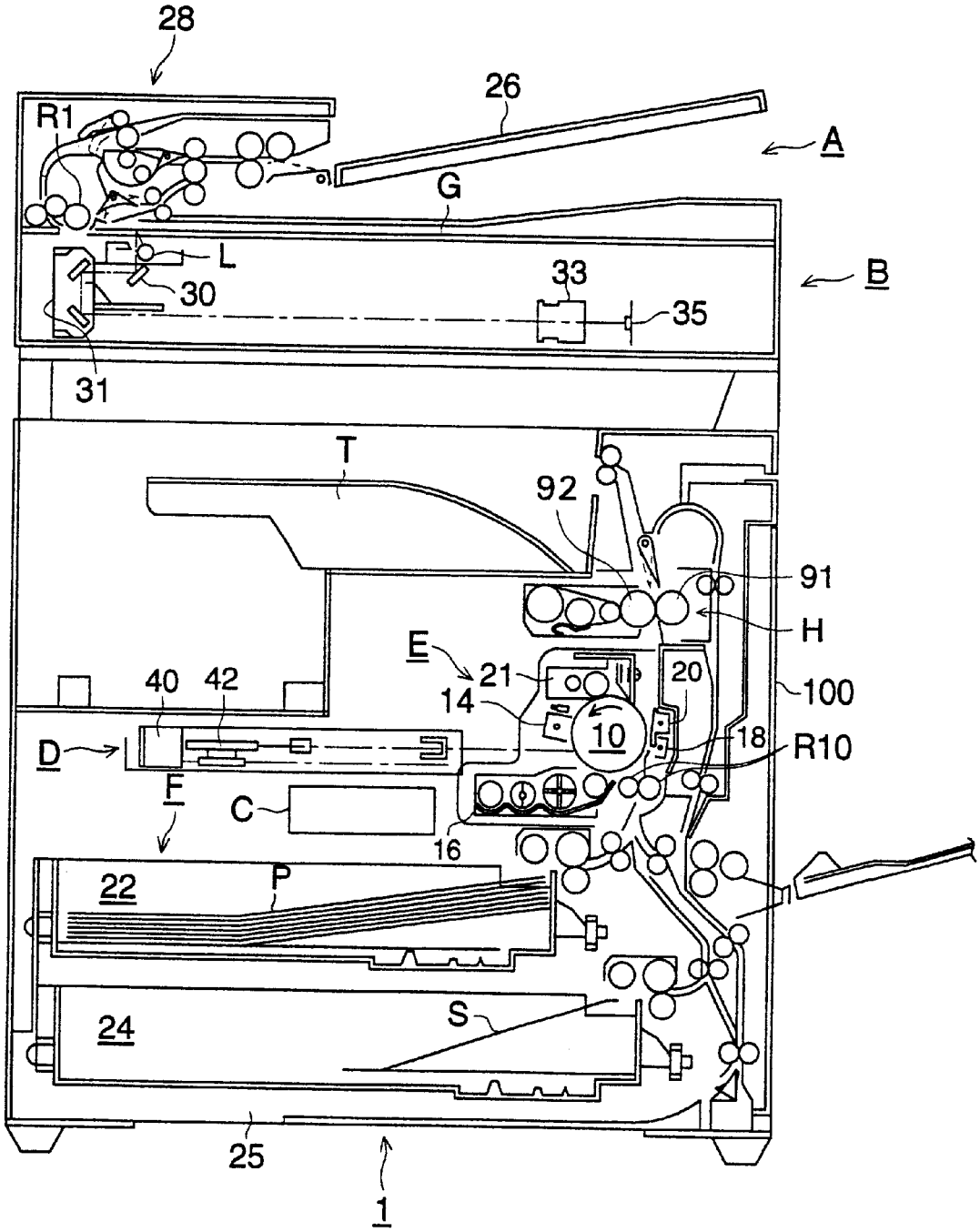
FIG. 10 is a drawing for illustrating the overall structure of an image forming apparatus provided with a fixing apparatus of this example of the embodiment of the invention.

First, with reference to FIG. 10, the overall structure of an image forming apparatus provided with a fixing apparatus of this example of the embodiment of the invention will be explained.

In the drawing, the image forming apparatus 1 comprises the automatic document feeder (what is called an ADF) A, the original image reading unit B for reading an image of an original conveyed by the automatic document feeder A, the image control section C for processing the read original image, writing section D including the writing unit 12 for carrying out writing on the image carrying member 10 made up of a photoreceptor drum, the image forming section E including the image carrying member 10 and the image forming means disposed around it such as the charging electrode 14, the developing means 16 composed of a developing apparatus of the magnetic brush type, the charging electrode 18, the detaching electrode 20, and the cleaning means 21, the receiving section F for the plural paper receiving means (hereinafter referred to as a paper feeding tray or a tray) 22 and 24 such as a tray for receiving the transfer material (hereinafter referred to as the recording paper) P, and so forth.

The automatic document feeder A comprises as main components the document stacking base 26 and the document convey-processing unit 28 including a group of rollers including the roller R1 and a switching means for suitably switching the moving path of a document sheet.

The original image reading unit B is composed of the two mirror units 30 and 31 which are disposed under the document glass plate G and capable of moving back and forth with the optical length kept the same, the fixed image forming lens (hereinafter referred to as the lens) 33, the line-shaped image sensor (hereinafter referred to as the CCD) 35, etc., and the writing section D is composed of the laser light source 40, the polygonal mirror (deflector) 42, etc.

With respect to the automatic document feeder A, the principle itself is publicly known although it is different from the conventional automatic document feeders in the structure; further, the original image reading unit B, the writing section D, the image forming apparatus provided with the image processing means (means for forming a toner image on the image carrying member 10 and transferring the toner image onto a sheet), and the image forming process are well known; therefore, explanation of them will be done simply.

Besides, R10, which is shown at the upstream side of the transfer electrode 19; is the registration roller, and H, which is shown at the downstream side of the detaching electrode, is the fixing apparatus (to be described in detail) and is provided with the heating roller 91 and the pressing roller 92 being in pressure contact with the heating roller 91; by making a sheet of the recording paper P having a toner image transferred on it pass through the pressing roller 92 and the heating roller 91, the toner image is thermally fixed on the sheet of the recording paper P.

In the above-described structure, the process, in which a toner image is formed on the image carrying member 10, and the image is transferred onto a sheet, after that, the sheet is ejected onto an output tray, is as follows:

In addition, in this specification, in some cases, the transfer area provided with the transfer electrode is called the image recording section.

A sheet of the document (not shown in the drawing) stacked on the document stacking base 26 is conveyed in the document convey-processing unit 28, and while it passes under the roller R1, a slit exposure by the exposure means L is carried out.

The reflected light from the document passes through the mirror units 30 and 31 disposed at fixed positions and the lens 33, is focused on the CCD, and is read.

The image information read by the original image reading unit B is processed by the image processing means and coded, to be stored in a memory provided on the image control board C.

The image data is read out in response to image forming, and the laser light source in the writing section D is driven in accordance with said image data, to make exposure to the image carrying member 10.

Preceding this exposure, the image carrying member 10, which is rotating in the direction of the arrow mark (counter clockwise direction) and has been charged to a predetermined electric surface potential by the corona discharge of the charging electrode 14, has its surface potential at the exposed portions reduced in accordance with the exposure amount; as the result, a latent electrostatic image corresponding to the image data is formed on the image carrying member 10.

The latent electrostatic image is reverse-developed by the developing means 16, to make a visible image (toner image).

On the other hand, before the leading edge portion of the toner image on the image carrying member 10 reaches the transfer area, a sheet of the recording paper P in the paper feeding tray 22, for example, is fed and conveyed to reach the registration roller R10, where its leading edge is adjusted.

The sheet P is conveyed to the transfer area in order that it may be superposed on the toner image, that is, the image area on the image carrying member 10, by the registration roller R10 which starts rotating in synchronism with the toner image.

In the transfer area, the toner image on the image carrying member 10 is transferred onto the sheet P by actuating the transfer electrode, and next, the sheet P is detached from the image carrying member 10 by actuating the detaching electrode 20.

After that, by the heating and pressing of the fixing apparatus H, the toner particles forming the toner image are fused and fixed on the sheet P, which is then ejected onto the output tray T through the paper ejection path and the paper ejecting roller.

Fixing Apparatus

Figure 1:
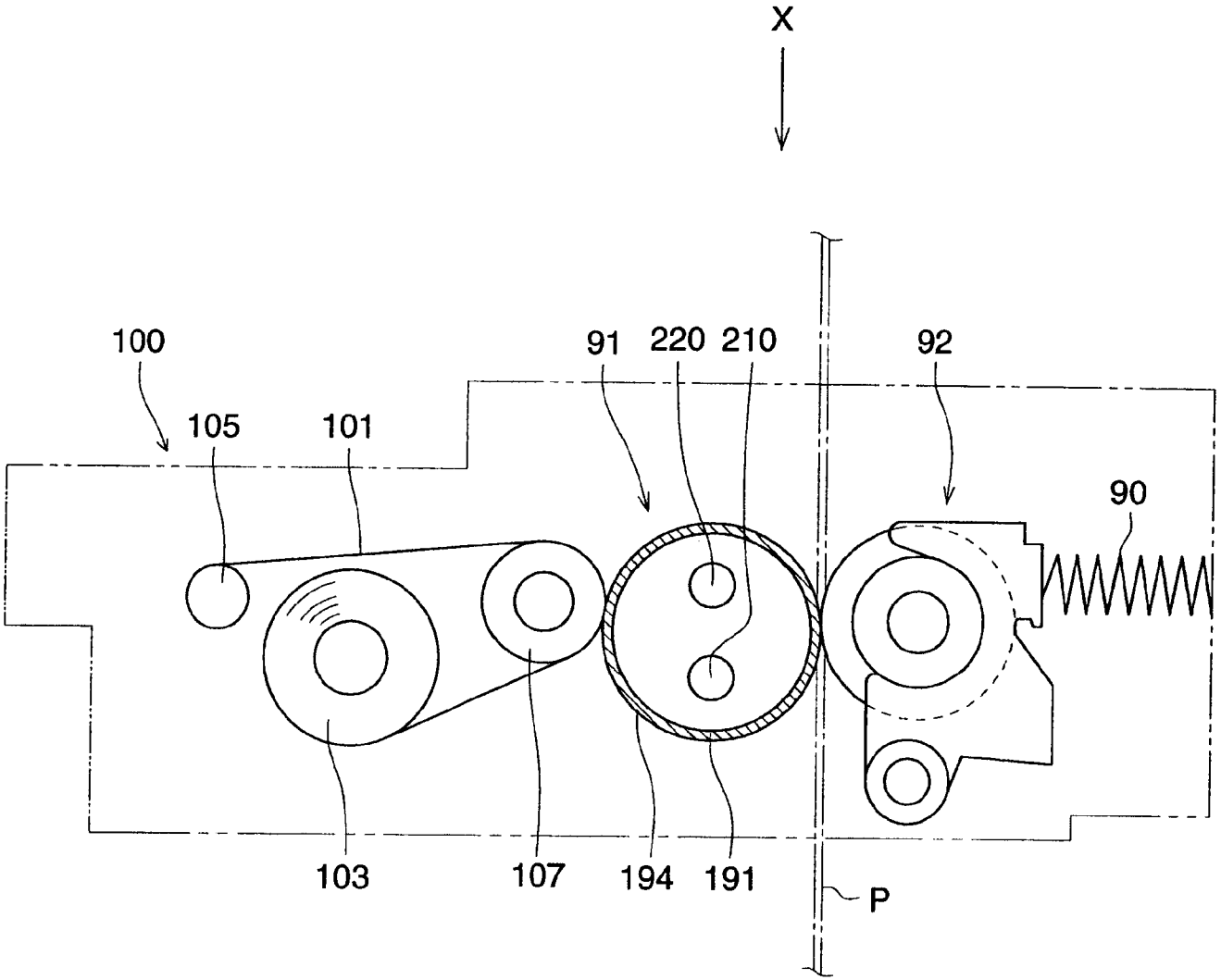
FIG. 1 is a side view of a fixing apparatus of an example of the embodiment of the invention.
Figure 2:
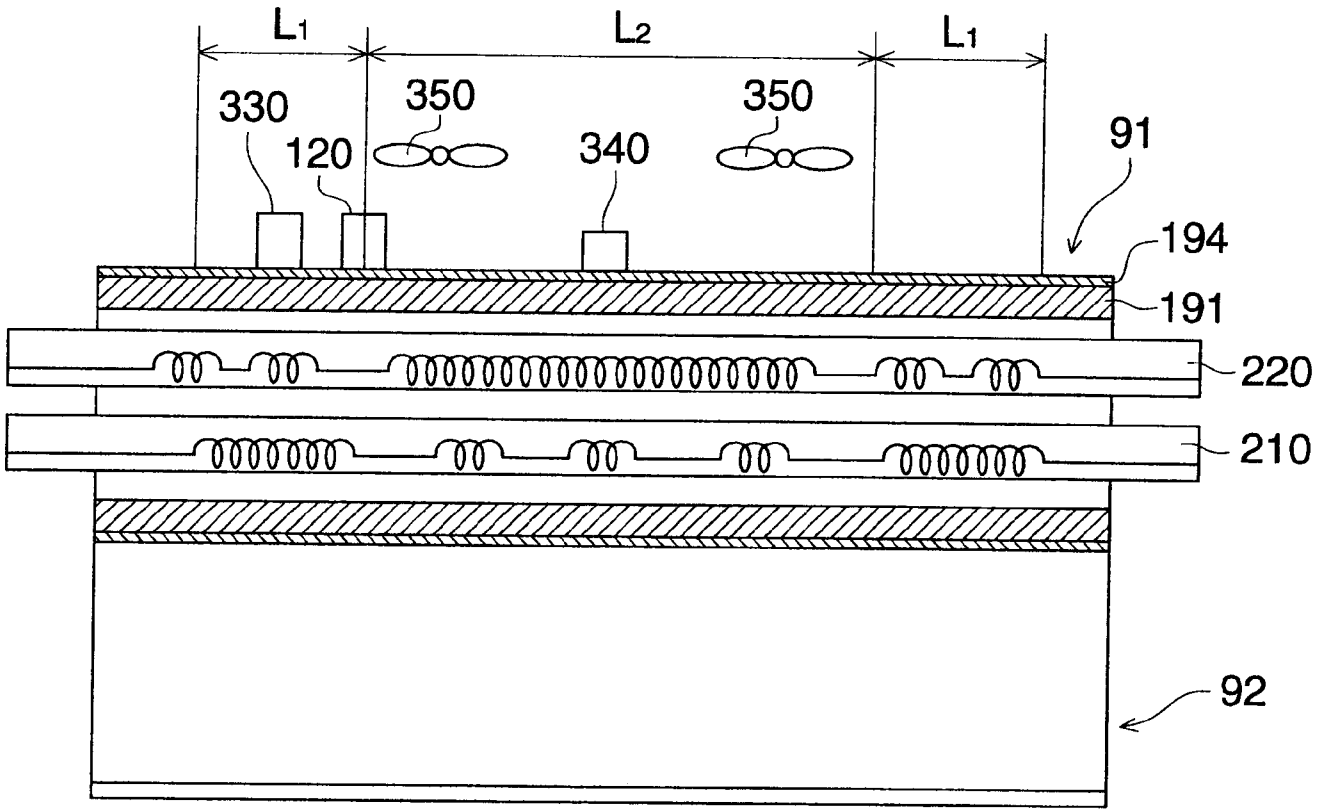
FIG. 2 is the cross-sectional view of FIG. 1 along the direction of the arrow mark X.

The structure of the fixing apparatus H will be explained in detail with reference to FIG. 1 and FIG. 2. FIG. 1 is a side view of the fixing apparatus H, and FIG. 2 is the cross-sectional view along the direction of the arrow mark X in FIG. 1.

In the heating roller 91, 191 denotes the cylindrical sleeve (roller base member) with the both side ends opened.

On the outer circumferential surface of this sleeve 191, the releasing layer 194 is formed.

In this example of the embodiment of the invention, the material of the sleeve 191 is either aluminum or iron, and the material of the releasing layer 194 is a resin such as a PFA (copolymer of tetrafluoro-ethylene/perfluoro-alkylvinyl ether) or a tetrafluoro-ethylene.

Further, the thickness of the sleeve 191 is equal to or smaller than 2.0 mm, and the film thickness of the releasing layer is approximately 20 $\mu$m.

Inside the heating roller 91, there are provided the first halogen heater lamp 210 as the first heating means for mainly heating the area (L1) which is inside the area which a sheet of recording paper P of the maximum size passes and is outside the area which a sheet of recording paper P of the predetermined size passes, and the second halogen heater lamp 220 as the second heating means for mainly heating the area (L2) which a sheet of recording paper P of the predetermined size passes.

In addition, in this example of the embodiment of the invention, the heat distribution ratio in the first halogen heater lamp 210 for the area (L2), which a sheet of recording paper P of the predetermined size passes, is in a range of 15–70%, on condition that the ratio for the area (L1), which is outside the area which a sheet of recording paper P of the predetermined size passes, is 100%.

Further, the heat distribution ratio in the second halogen heater lamp 220 for the area (L1), which is outside the area which a sheet of recording paper P of the predetermined size passes, is equal to or smaller than 60%, on condition that the ratio for the area (L2), which a sheet of recording paper P of the predetermined size passes, is 100%.

The pressing roller 92 has a structure having a PFA tube covering the circumferential surface of the foaming silicone rubber, and its surface hardness is in a range of 35–75° (Asker C hardness).

Further, the pressing roller 92 presses the heating roller 91 with a total load 5–25 kgf by the urging force of the spring 90, to make the nip pressure between the pressing roller 92 and the heating roller 91 0.2–2.0 kgf/cm$^2$, and the nip passing time is 20–40 msec.

In the fixing apparatus H of this example of the embodiment of the invention, as shown in FIG. 2, two temperature detecting means 330 and 340 are provided. One is the first temperature detecting means 330 for detecting the temperature of the area L1 of the heating roller 91, and the other is the second temperature detecting means 340 for detecting the temperature of the area L2 of the heating roller 91. In addition, in this example of the embodiment, a thermister is used for the temperature detecting means.

Further, in the neighborhood of the border of the first halogen heater lamp 210 and the second halogen heater lamp 220 of the heating roller 91, the thermostat 120 is provided. 350 denotes the fan as the cooling means for cooling the end portions of the area L2.

The cleaning mechanism 100 is composed of the supplying roller 103 having the web 101 made of nonwoven fabric of an aromatic polyamide wound on it, the take-up roller 105 for winding up the web 101, and the backup roller 107 for pressing the web to the heating roller 91.

This take-up roller 105 is driven to rotate by a predetermined amount after image formation is made on a predetermined number of sheets of the recording paper P, and the unused portion of the web 101 is pressed to the heating roller 91.

Figure 3:
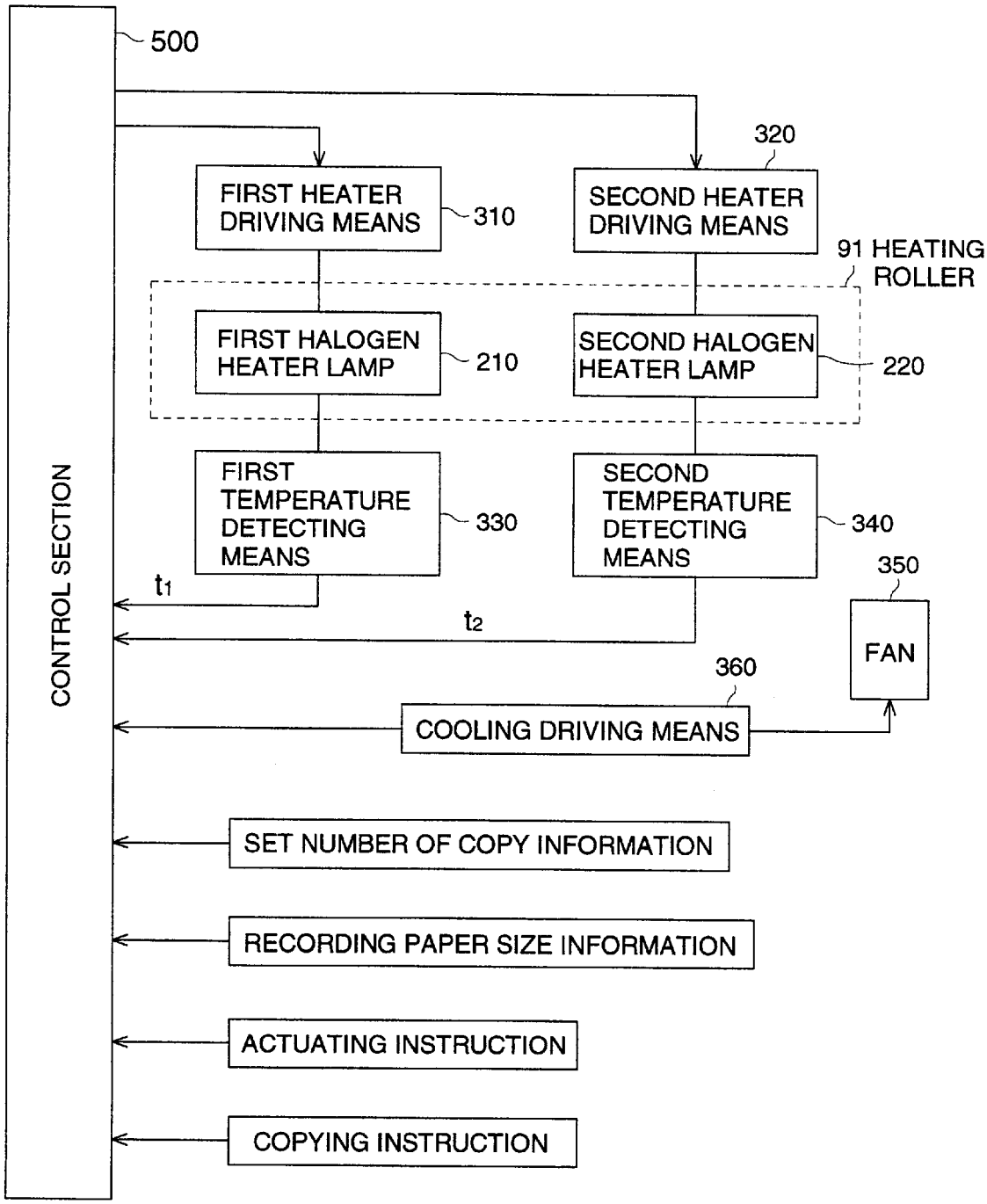
FIG. 3 is a block diagram for illustrating the electrical structure of the fixing apparatus shown in FIG. 1.

In the following, with reference to FIG. 3, the electrical structure of the fixing apparatus of this example of the embodiment will be explained. FIG. 3 is a block diagram for illustrating the electrical structure of the fixing apparatus shown in FIG. 1.

In the drawing, 310 denotes the first heater driving means composed of a circuit driving the first halogen heater lamp 210, and 320 denotes the second heater driving means composed of a circuit driving the second halogen heater lamp 220.

500 denotes the control section, and drives the first and second halogen heater lamps 210 and 220 through the first and second heater driving means 310 and 320 and the fan 350 through the cooling driving means 360, by receiving the temperature information (t1) from the first temperature detecting means 330, the temperature information (t2) from the second temperature detecting means 340, the actuating instruction transmitted from the image forming apparatus mainframe when the power switch of the image forming apparatus mainframe is turned on, the copying instruction transmitted from the image forming apparatus mainframe when the copy button of the image forming apparatus mainframe is turned on, the recording paper size information (W), and the set copy number information (I).

In the following, the operation of the fixing apparatus having the above-described structure will be explained with reference to FIG. 4–FIG. 9.

Figure 4:
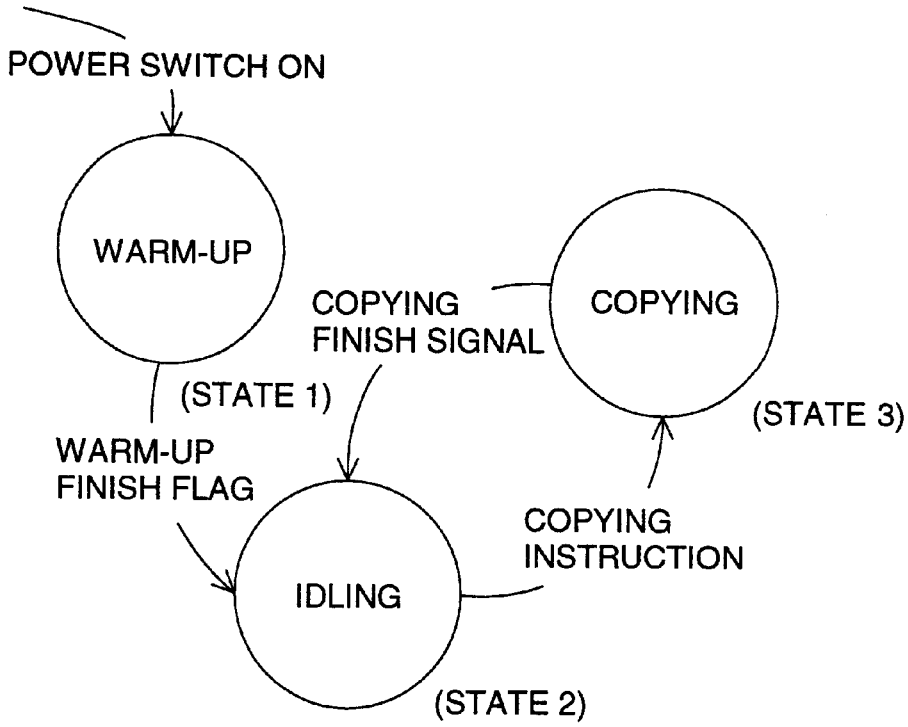
FIG. 4 is a drawing showing the transition of the state for illustrating the overall operation of the image forming apparatus provided with a fixing apparatus of this example of the embodiment of the invention.

First, with reference to FIG. 4, which is the state transition drawing for illustrating the overall operation of the image forming apparatus, the overall operation of the image forming apparatus will be explained. When the power switch is turned on, the warm-up operation (the state 1) is carried out, and when warm-up is finished, the finish flag is turned on, and the operation moves to the idling operation (the state 2).

If a copying instruction is given during the idling operation, the copying operation (the state 3) is carried out, and when the copying operation is finished, the operation returns to the idling operation (the state 2).

In the following, the warm-up operation, the idling operation, and the copying operation will be explained.

Warm-Up Operation

Explanation will be given with reference to FIG. 5 and FIG. 6 which are the flow charts for explaining the warm-up operation of the fixing apparatus shown in FIG. 1.

Figure 5:
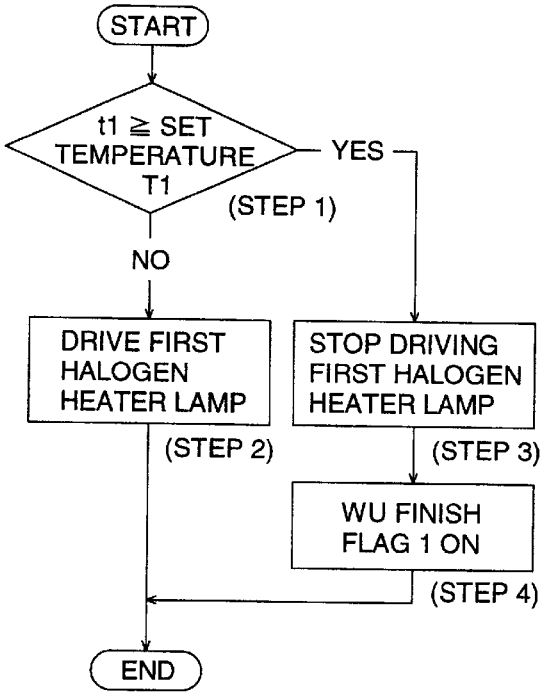
FIG. 5(*a*) and 5(*b*) are flow charts for explaining the warm-up operation of the fixing apparatus shown in FIG. 1: the drawing (a) is the flow chart showing the warm-up operation of the first halogen heater lamp, and the drawing (b) is the flow chart showing the warm-up operation of the second halogen heater lamp.
Figure 5:
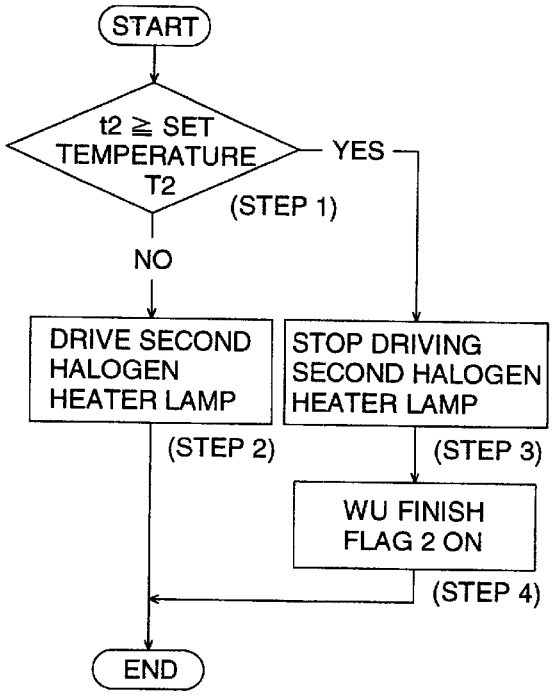

In FIG. 5, the drawing (a) is the flow chart showing the warm-up operation of the first halogen heater lamp, and the drawing (b) is the flow chart showing the warm-up operation of the second halogen heater lamp; FIG. 6 is the flow chart showing the finish judging operation for the warm-up operation.

Figure 6:
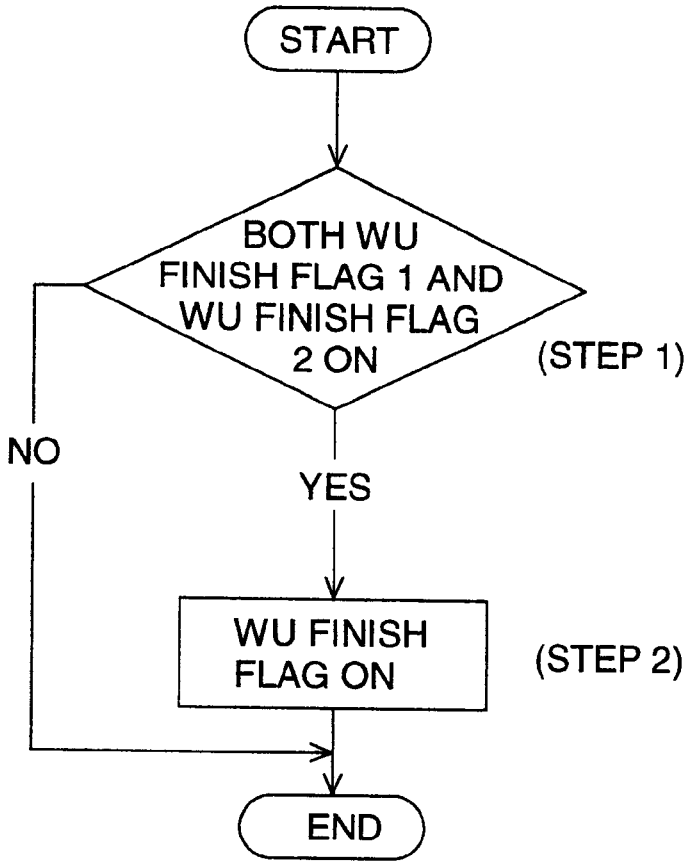
FIG. 6 is the flow chart for explaining the idling operation of the fixing apparatus shown in FIG. 1.

The control section 500 carries out as the warm-up operation three flows shown in FIG. 5(*a*), FIG. 5(*b*), and FIG. 6 every 200 msec.

In the flow shown in FIG. 5(*a*), it receives the temperature information (t1) from the first temperature detecting means 330, and makes a comparison between the temperature (t1) of the area L1 of the heating roller and the predetermined temperature (T1) (step 1).

If the temperature (t1) of the heating roller 91 is lower than the predetermined temperature (T1), the first halogen heater lamp 210 is driven (step 2).

If the temperature (t1) of the heating roller 91 is equal to or higher than the predetermined temperature (T1), the driving of the first halogen heater lamp 210 is stopped (step 3), and the warm-up (WU) finish flag 1 is turned on (step 4).

In the same manner, in the routine shown in FIG. 5(*b*), the control section receives the temperature information (t2) from the second temperature detecting means 340, and makes a comparison between the temperature (t2) of the area L2 of the heating roller and the predetermined temperature (T2) (step 1).

If the temperature (t2) of the heating roller 91 is lower than the predetermined temperature (T2), the second halogen heater lamp 220 is driven (step 2).

If the temperature (t2) of the heating roller 91 is equal to or higher than the predetermined temperature (T2), the driving of the second halogen heater lamp 220 is stopped (step 3), and the warm-up (WU) finish flag 2 is turned on (step 4).

In the flow shown in FIG. 6, it is watched whether both of the WU finish flag 1 and the WU finish flag 2 are on or not (step 1), and if both are on, the WU finish flag is turned on (step 2).

Idling Operation

Explanation will be given with reference to FIG. 7 which is the flow chart for explaining the idling operation of the fixing apparatus shown in FIG. 1.

Figure 7:
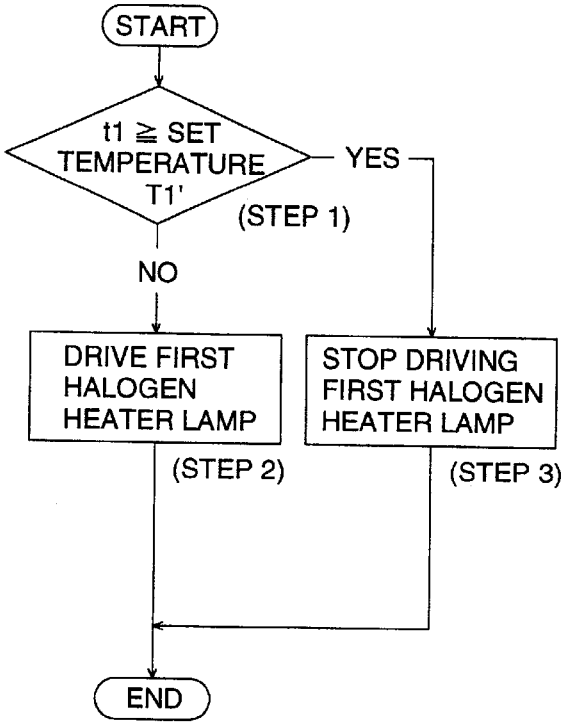
FIG. 7(*a*) and 7(*b*) are flow charts for explaining the idling operation of the fixing apparatus shown in FIG. 1: the drawing (a) is the flow chart showing the idling operation of the first halogen heater lamp, and the drawing (b) is the flow chart showing the idling operation of the second halogen heater lamp.
Figure 7:
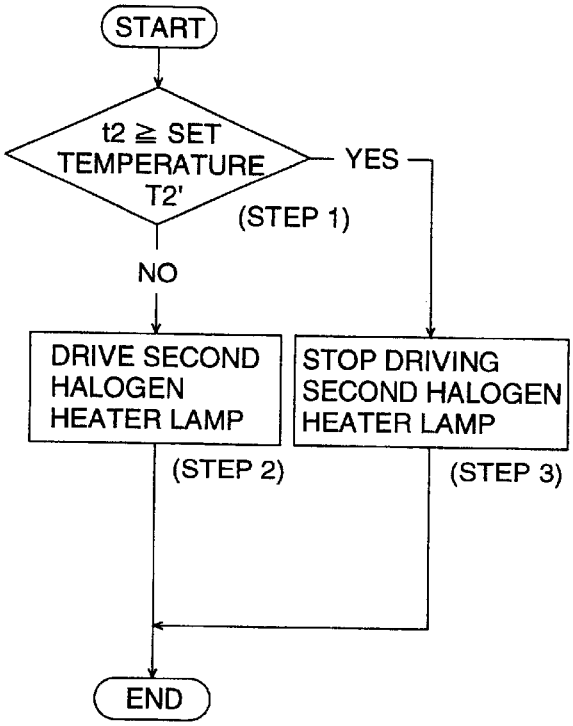

In FIG. 7, the drawing (a) is the flow chart showing the idling operation of the first halogen heater lamp, and the drawing (b) is the flow chart showing the idling operation of the second halogen heater lamp.

The control section 500 carries out as the idling operation two flows shown in FIG. 7(*a*) and FIG. 7(*b*) every 200 msec.

In the flow shown in FIG. 7(*a*), it receives the temperature information (t1) from the first temperature detecting means 330, and makes a comparison between the temperature (t1) of the area L1 of the heating roller and the predetermined temperature (T1') (step 1).

If the temperature (t1) of the heating roller 91 is lower than the predetermined temperature (T1'), the first halogen heater lamp 210 is driven (step 2).

If the temperature (t1) of the heating roller 91 is equal to or higher than the predetermined temperature (T1'), the driving of the first halogen heater lamp 210 is stopped (step 3).

In the same manner, in the flow shown in FIG. 7(*b*), the control section receives the temperature information (t2) from the second temperature detecting means 340, and makes a comparison between the temperature (t2) of the area L2 of the heating roller and the predetermined temperature (T2') (step 1).

If the temperature (t2) of the heating roller 91 is lower than the predetermined temperature (T2'), the second halogen heater lamp 220 is driven (step 2).

If the temperature (t2) of the heating roller 91 is equal to or higher than the predetermined temperature (T2'), the driving of the second halogen heater lamp 220 is stopped (step 3).

Copying Operation

Explanation will be given with reference to FIG. 8 and FIG. 9 which are the flow charts for explaining the copying operation of the fixing apparatus shown in FIG. 1.

Figure 8:
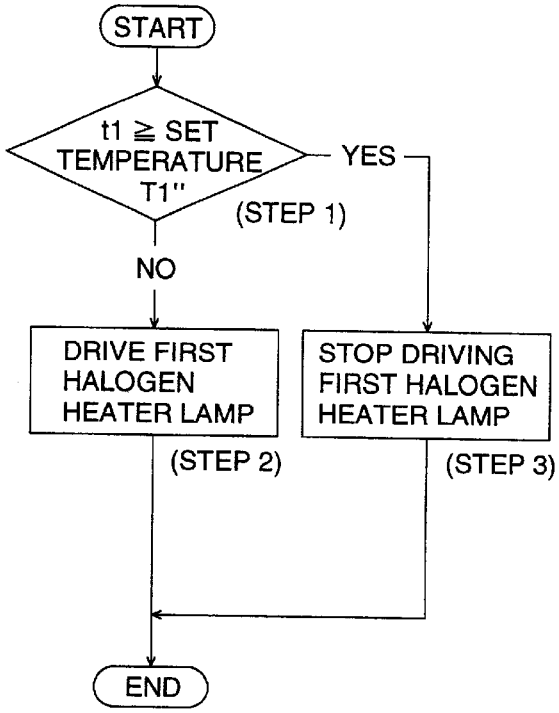
FIG. 8(*a*) and 8(*b*) are flow charts for explaining the copying operation of the fixing apparatus shown in FIG. 1: the drawing (a) is the flow chart showing the copying operation of the first halogen heater lamp, and the drawing (b) is the flow chart showing the copying operation of the second halogen heater lamp.
Figure 8:
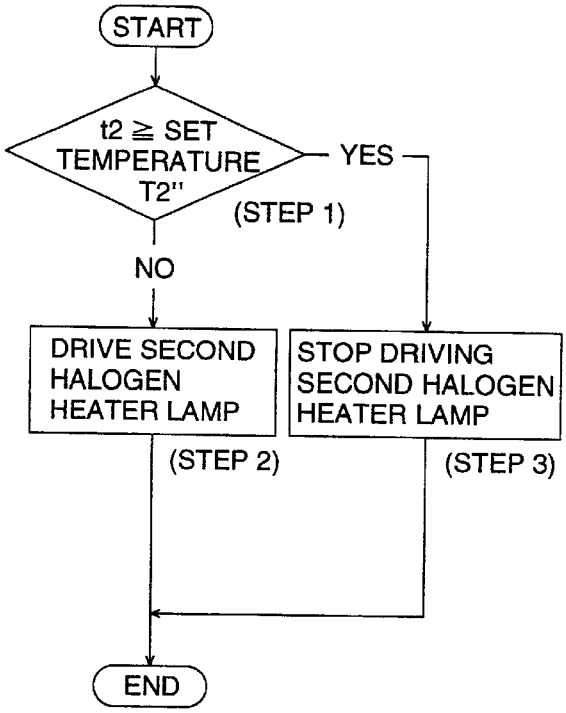

In FIG. 8, the drawing (a) is the flow chart showing the copying operation of the first halogen heater lamp, and the drawing (b) is the flow chart showing the copying operation of the second halogen heater lamp. Further, In FIG. 9, the drawing (a) is the flow chart showing the driving operation of the cooling fan, and the drawing (b) is the flow chart showing the stopping operation of the cooling fan.

The control section 500 carries out as the copying operation two flows shown in FIG. 8(*a*) and FIG. 8(*b*) every 200 msec.

In the flow shown in FIG. 8(*a*), it receives the temperature information (t1) from the first temperature detecting means 330, and makes a comparison between the temperature (t1) of the area L1 of the heating roller and the predetermined temperature (T1") (step 1).

If the temperature (t1) of the heating roller 91 is lower than the predetermined temperature (T1"), the first halogen heater lamp 210 is driven (step 2).

If the temperature (t1) of the heating roller 91 is equal to or higher than the predetermined temperature (T1"), the driving of the first halogen heater lamp 210 is stopped (step 3).

In the same manner, in the flow shown in FIG. 8(*b*), the control section receives the temperature information (t2) from the second temperature detecting means 340, and makes a comparison between the temperature (t2) of the area L2 of the heating roller and the predetermined temperature (T2") (step 1).

If the temperature (t2) of the heating roller 91 is lower than the predetermined temperature (T2"), the second halogen heater lamp 220 is driven (step 2).

If the temperature (t2) of the heating roller 91 is equal to or higher than the predetermined temperature (T2"), the driving of the second halogen heater lamp 220 is stopped (step 3).

Figure 9:
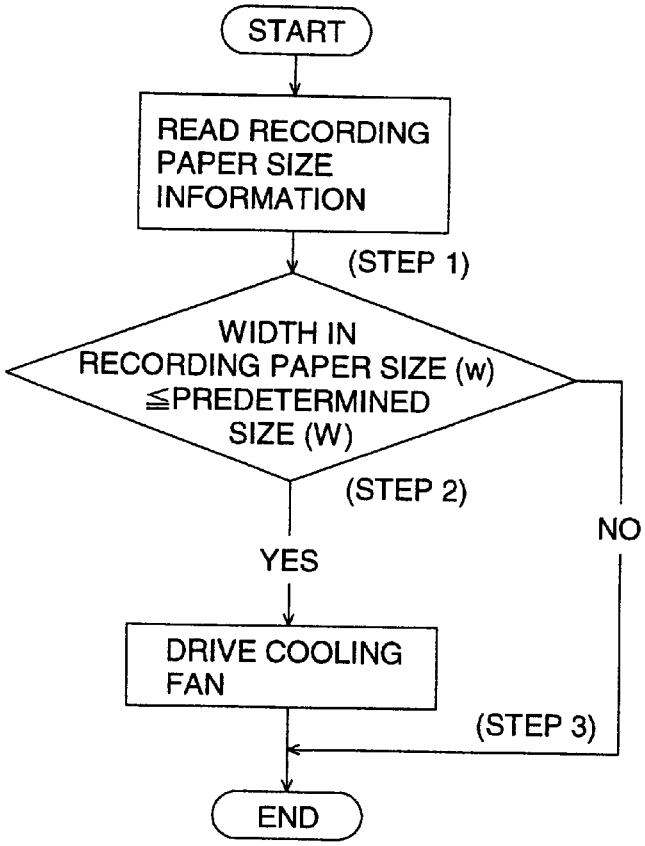
FIG. 9(*a*) and 9(*b*) are flow charts for explaining the copying operation of the fixing apparatus shown in FIG. 1: the drawing (a) is the flow chart showing the driving operation of the cooling fan, and the drawing (b) is the flow chart showing the stopping operation of the cooling fan.
Figure 9:
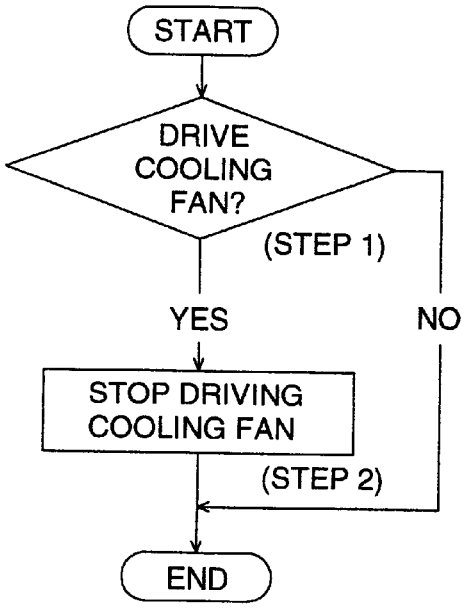

Further, when a copying instruction is given, the control section carries out once the flow shown in FIG. 9(*a*).

In the flow shown in FIG. 9(*a*), when a copying instruction is given, the control section 500 reads the size information (w) of the recording paper P to be fed (step 1), and compares it with the predetermined size (W) (step 2); if the size (w) of the recording paper P to be fed is equal to or smaller than the predetermined size (W), the cooling fan 350 is driven (step 3).

Further, when a copy finishing instruction is given, the control section 500 carries out once the flow shown in FIG. 9(*b*).

In the flow shown in FIG. 9(*b*), when a copy finishing instruction is given, and if the cooling fan 350 is being driven (step 1), the control section 500 stops the driving of the cooling fan 350 (step 2).

According to the above-described structure and the method of control, the effects as described below can be obtained.

(1) By making the material of the sleeve of the heating roller either aluminum or iron and the thickness of the sleeve equal to or smaller than 2.0 mm, that is, making it thin, the heat capacity of the heating roller is made small, which makes the thermal efficiency high.

Further, by making the material of the pressing roller a silicone rubber, making its surface hardness (Asker C hardness) 35–75°, making the pressing roller 92 press the heating roller with a total load of 5–25 kgf, and making the nip pressure between said heating roller and said pressing roller 0.2–2.0 kgf/cm$^2$, and the nip passing time 20–40 msec, the nip time of a transfer material is made long; thus, the heat quantity to be supplied to the transfer material can be secured.

(2) By providing a first halogen heater lamp 210 for heating the area (L1) which is outside the area which a sheet of recording paper P of the predetermined size passes, and a second halogen heater lamp 220 for heating the area (L2) which a sheet of recording paper P of the predetermined size passes, and independently controlling for driving the first halogen heater lamp 210 and the second halogen heater lamp 220, even in the case where a sheet of recording paper P having a size equal to or smaller than the predetermined size is fixed, it can be prevented the temperature rise of the portion which no sheet of paper comes in contact with and is inside the area which a sheet of recording paper P of the maximum size passes and is outside the area which a sheet of recording paper P of the predetermined size passes; thus, the useless area is not heated and the electric power consumption of the halogen heater lamps is reduced.

(3) By making the heat distribution ratio in the first halogen heater lamp 210 for the area (L2), which a recording paper P of the predetermined size passes, is in a range of 15–70%, on condition that the ratio for the area (L1), which is outside the area which a recording paper P of the predetermined size passes, is 100%, the power consumption during idling can be decreased, and even if the second halogen heater lamp 220 is in the off-state, the temperature over the whole area of the heating roller 91 can be kept approximately uniform by turning the first halogen heater lamp 210 on and off.

The number of times of turning on and off of the halogen heater lamps 210 and 220 can be reduced, and the generation of a noise can be prevented.

(4) By making the heat distribution ratio in the second halogen heater lamp 220 for the area (L1), which is outside the area which a recording paper P of the predetermined size passes, equal to or smaller than 60%, on condition that the ratio for the area (L2), which a recording paper P of the predetermined size passes, is 100%, even when plural sheets of recording paper P having a width smaller than the predetermined size are continuously fixed, the temperature of the heating roller 91 can be kept at a predetermined temperature by only the second halogen heater lamp 220.

(5) By providing a first temperature detecting means 330 for detecting the temperature of the area (L1) of the heating roller 91 which is inside the area which a sheet of recording paper P of the maximum size passes and is outside the area which a sheet of recording paper P of the predetermined size passes, and a second temperature detecting means 340 for detecting the temperature of the area (L2) of the heating roller 91 which a sheet of recording paper of the predetermined size passes, a precise temperature control for the first halogen heater lamp 210 and the second halogen heater lamp 220 can be done, and the electric power consumption is reduced.

(6) By providing a thermostat 120 in the neighborhood of the border of the first halogen heater lamp 210 and the second halogen heater lamp 220 of the heating roller 91, in the case where the formation of an image is continuously carried out on a large number of sheets of recording paper P having a width smaller than the predetermined size, the temperatures of the both side portions in the first halogen heater lamp 210 rise extremely; however, by cutting the supply of the electric power to the first halogen heater lamp 210 by the thermostat, it can be prevented that the heating roller 210 reaches a temperature higher than the set temperature, and further, the electric power consumption is reduced.

(7) By providing a cooling fan 350 for cooling the both side portions of the area of the heating roller 91 which a sheet of recording paper P of the predetermined size passes, in the case where the formation of an image is carried out on sheets of recording paper P having a width smaller than the predetermined size, when the temperatures of the both side portions in the second halogen heater lamp 220 rise extremely, it can be prevented by cooling the heating roller 91 by the cooling fan 350 that the heating roller 91 reaches a temperature higher than the set temperature.

(8) Because only the web 101 having a small heat capacity of the cleaning mechanism 100 is in contact with the heating roller 91, the electric power consumption is small.

EXAMPLE OF PRACTICE

The inventors of this application carried out the following experiments in order to confirm the effects of this invention.

Thickness Of The Sleeve

When the temperatures of the end portions rise, the heating roller is cooled by the cooling fan; sleeves having a smaller thickness have a larger effect.

The inventors of this application measured the cooling effect by the cooling fan and the WUT (Warm Up Time) in the case where the thickness of the sleeve was varied.

Figure 11:
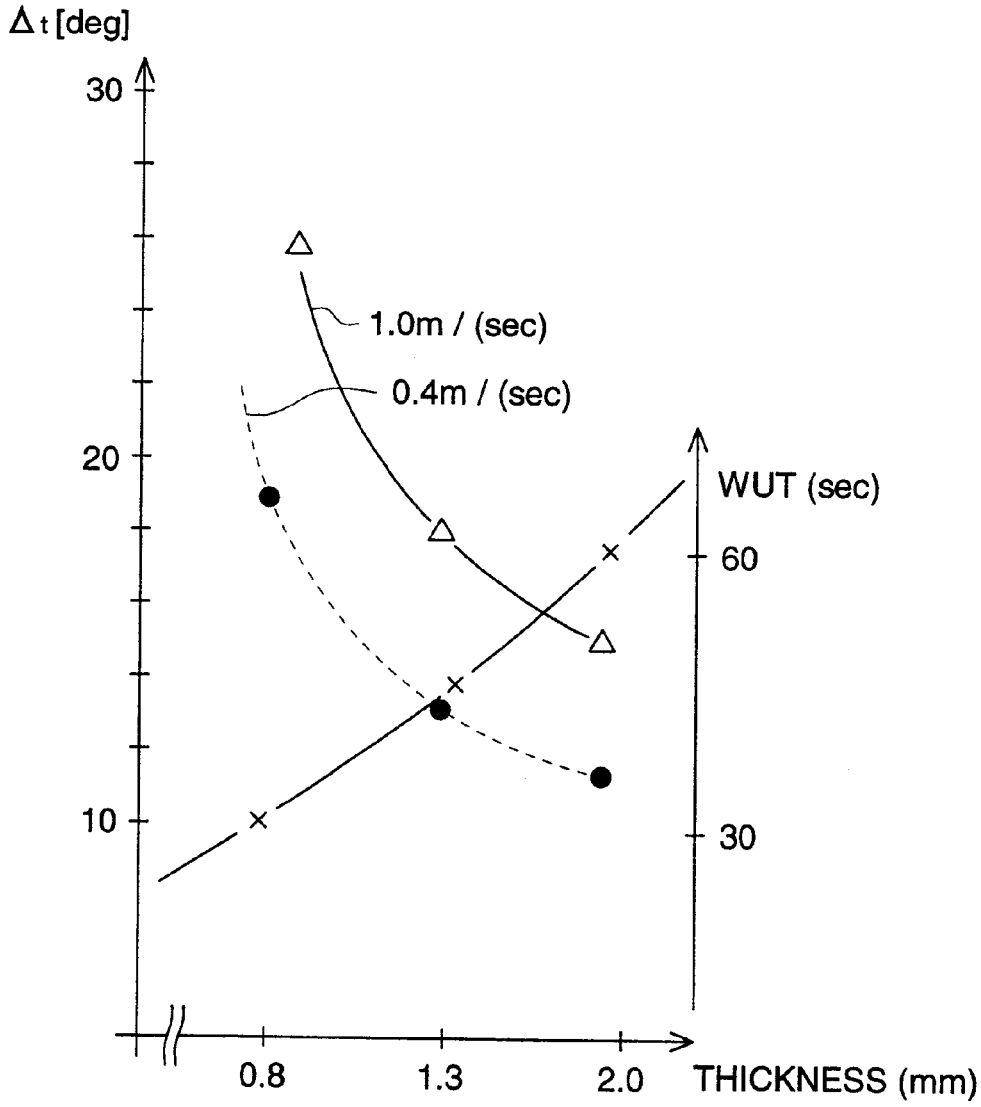
FIG. 11 is a graph for explaining the relation between cooling effect by the cooling fan and WUT (Warm Up Time) in the case where the thickness of the sleeve is varied.

The result is shown in FIG. 11.

The thickness (mm) of the sleeve made of aluminum is given to the abscissa, the cooling effect ($\Delta t$: deg) is given to the left side ordinate, and the WUT (sec) is given to the right side ordinate.

Further, in observing the cooling effect, the temperature drop is observed by applying air flows having a speed of 1.0 m/sec and 0.4 m/sec respectively to the heating roller.

If the sleeve thickness is equal to or larger than 2.0 mm, it becomes unpractical because the WUT exceeds 60 seconds; further, only the temperature drop equal to or smaller than 16° C. can be obtained, hence, it could be confirmed that the sleeve thickness should be equal to or smaller than 2.0 mm.

Nip Passing Time

The inventors of this application studied the relation between the nip passing time and the fixing efficiency and the relation between the nip passing time and the amount of curl.

The result is shown in FIG. 12. The drawing (a) shows the relation between the nip passing time and the fixing efficiency and the drawing (b) shows the relation between the nip passing time and the amount of curl.

The drawing (a) shows that if the nip passing time exceeds 20 msec, the fixing efficiency is 80%+$\alpha$ and is approximately constant. For the nip passing time shorter than 2.0 msec, the fixing efficiency becomes lower than 80%, and if a recording paper sheet having been subjected to such fixing is fed by an ADF (automatic document feeder) as an original document, in some cases the surface of the recording paper sheet is rubbed by the separation roller etc., to make the toner peel off.

If the fixing efficiency is equal to or higher than 80%, such phenomenon does not occur. Therefore, the nip passing time is required to be equal to or longer than 20 msec.

On the other hand, the drawing (b) shows that if the nip passing time increases, the amount of curl becomes large. If the amount of curl becomes equal to or larger than 10 mm, a paper jam is easy to occur in an ADF etc. Therefore, the nip passing time should desirably be equal to or shorter than 40 msec.

Nip Pressure

In the fixing apparatus composed of a heating roller having a sleeve thickness equal to or smaller than 2.0 mm and a pressing roller having a foaming silicone rubber layer, the nip pressure in the condition shown below was calculated.

Load acting on the heating roller by the pressing roller: 5–25 kgf;

Nip width: 4–8 mm;

Length in the axial direction of each roller: 310 mm;

A Minimum nip pressure: $5/(8\times310)=0.002$ kgf/mm$^2$=0.2 kgf/cm$^2$;

Maximum nip pressure: $25/(4\times310)=0.02$ kgf/mm$^2$=2.0 kgf/cm$^2$.

Figure 13:
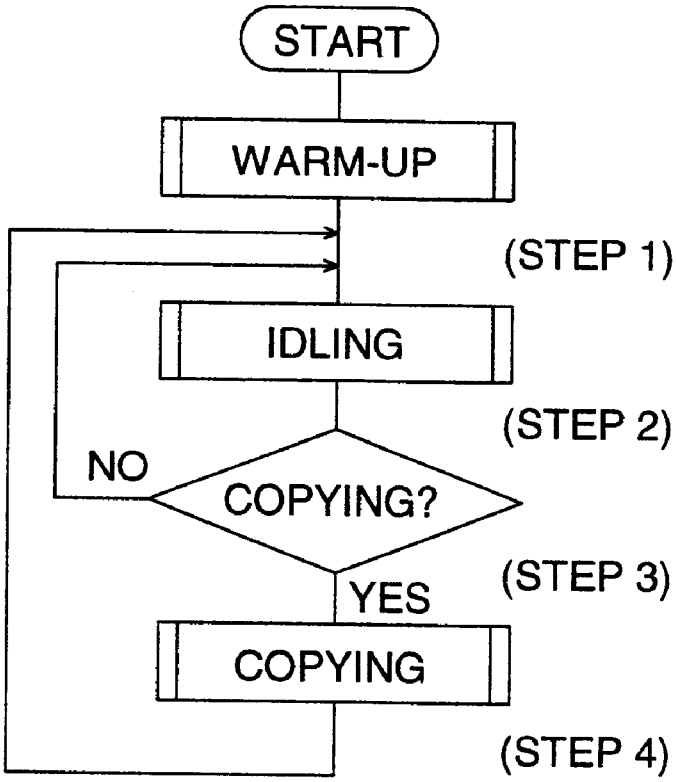
FIG. 13 is the flow chart for explaining the overall operation of an image forming apparatus.
Figure 14:
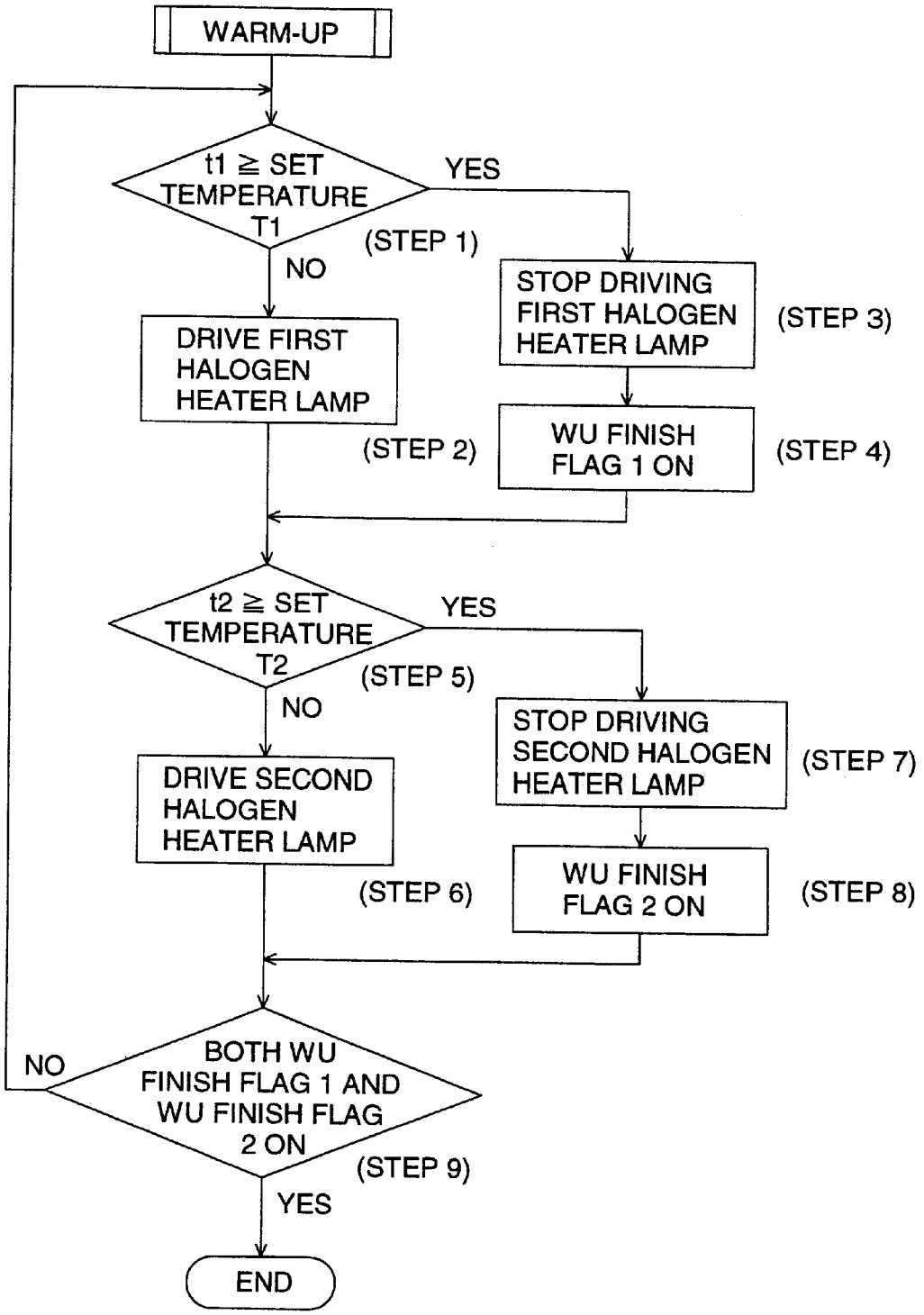
FIG. 14 is the flow chart for explaining the warm-up operation in FIG. 13.
Figure 15:
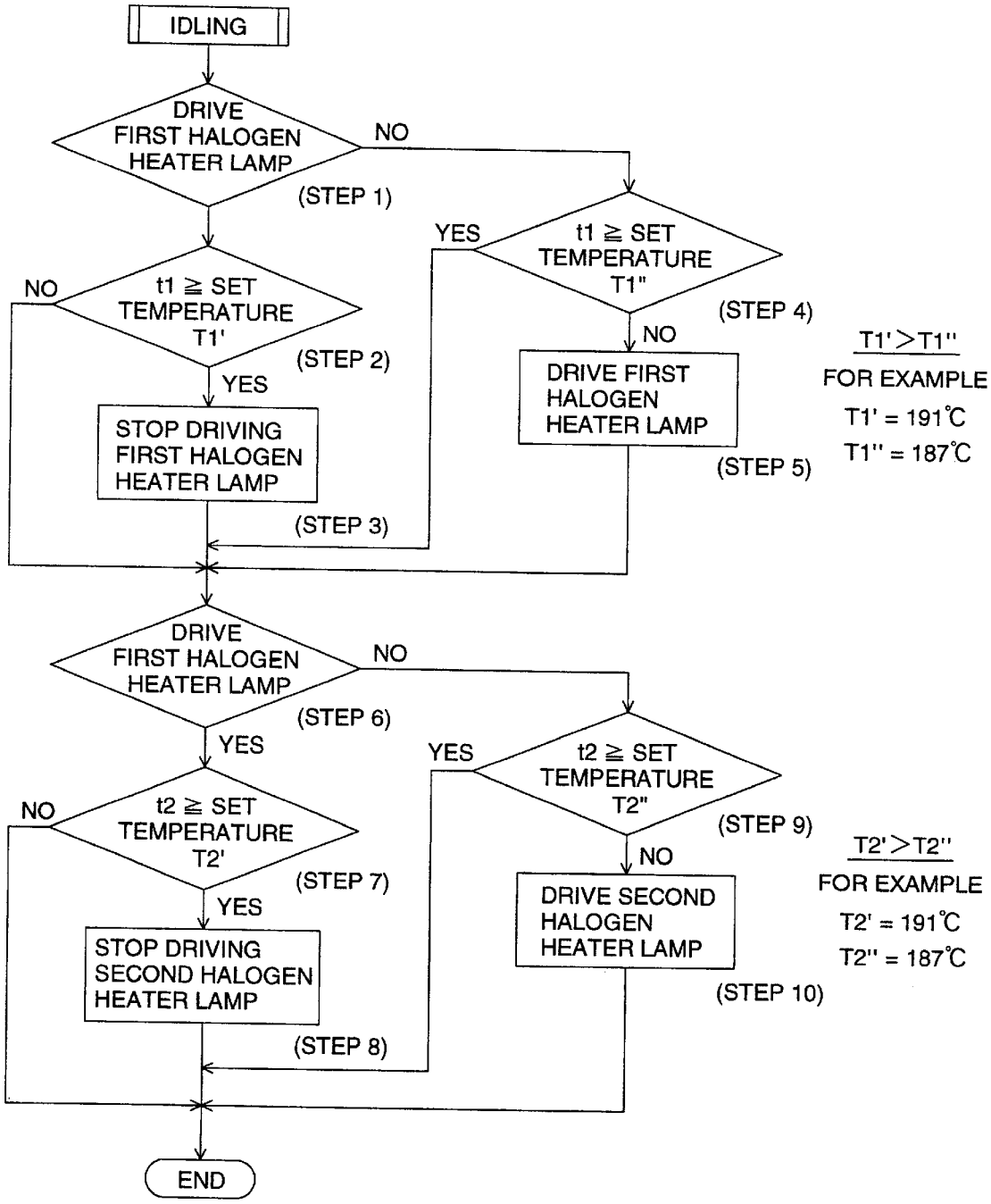
FIG. 15 is the flow chart for explaining the idling operation in FIG. 13.
Figure 16:
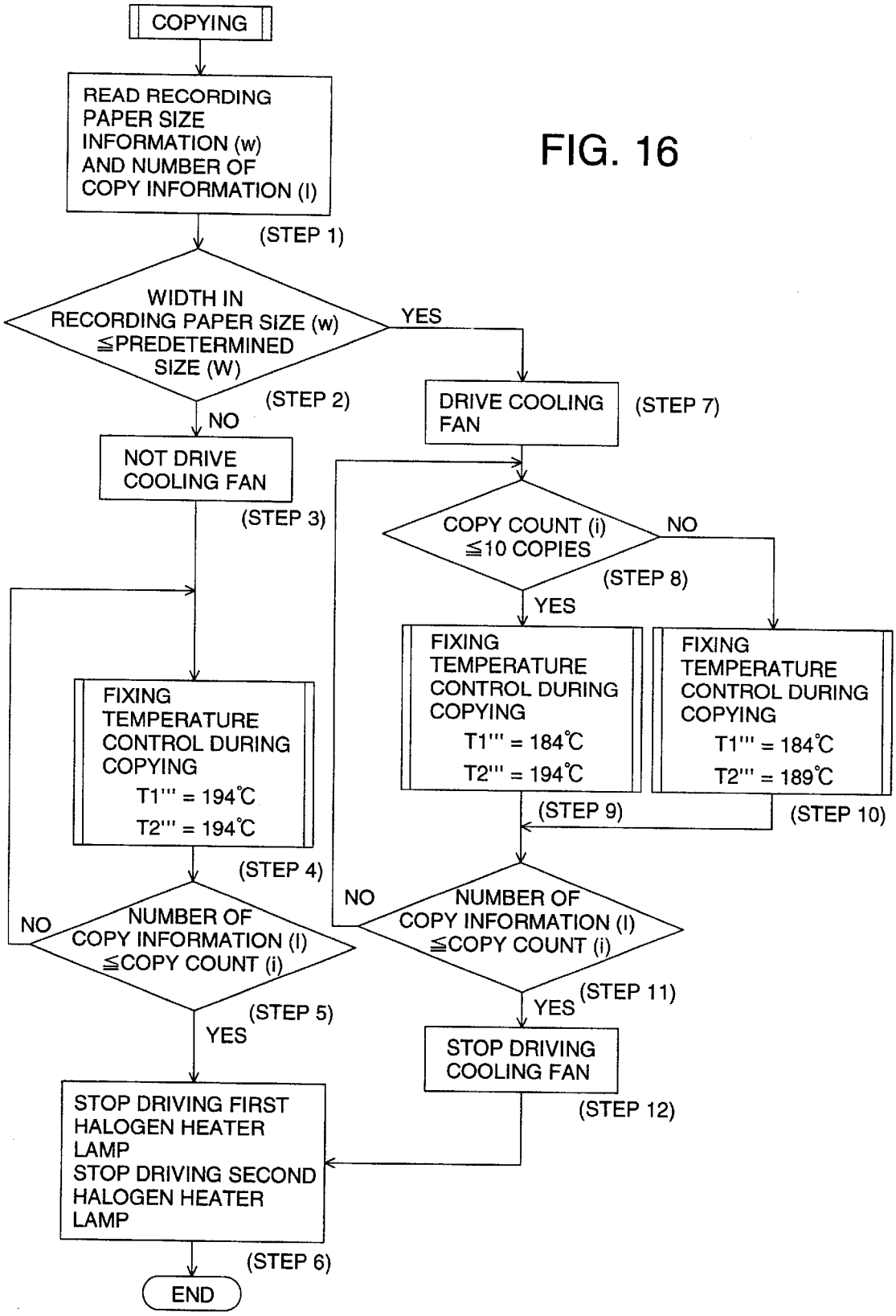
FIG. 16 is the flow chart for explaining the operation in copying of the fixing apparatus shown in FIG. 1.
Figure 17:
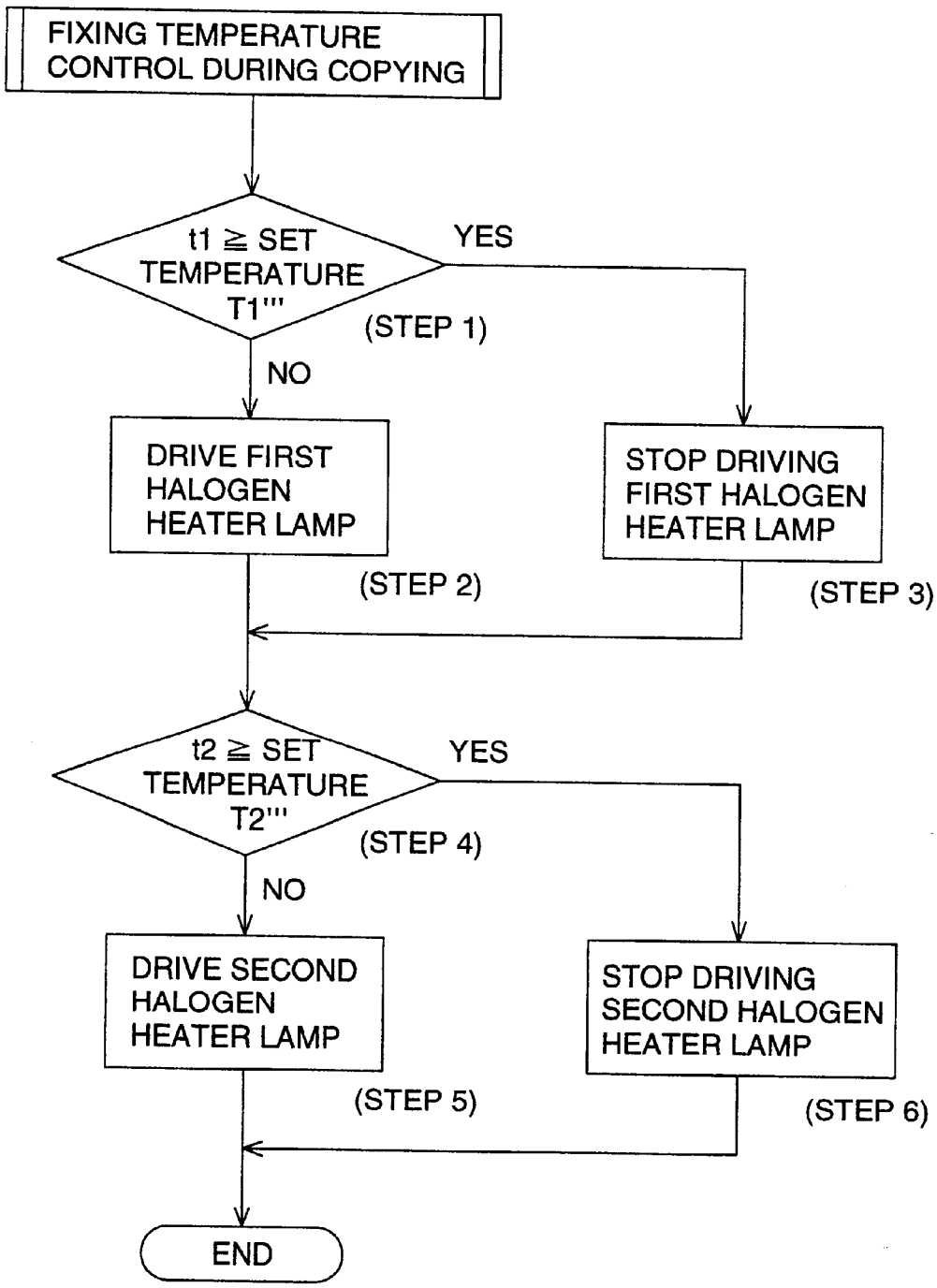
FIG. 17 is the flow chart for explaining the fixing control during copying in FIG. 16.

Further, the operation of the above-described fixing apparatus will be explained with reference to FIG. 13–FIG. 17. FIG. 13 is the flow chart for explaining the over all operation of an image forming apparatus, FIG. 14 is the flow chart for explaining the warm-up operation in FIG. 13, FIG. 15 is the flow chart for explaining the idling operation in FIG. 13, FIG. 16 is the flow chart for explaining the operation in copying of the fixing apparatus shown in FIG. 1, and FIG. 17 is the flow chart for explaining the fixing control during copying in FIG. 16.

First, with reference to FIG. 13, the overall operation of the image forming apparatus will be explained.

When the power switch is turned on, the operation to make the temperature of the heating roller 91 the predetermined temperature, that is, warm-up is carried out (step 1).

When warm-up is finished, the operation such that the heating roller 91 is kept at the predetermined temperature, that is, idling is carried out (steps 2 and 3).

When the copy button is turned on, copying is carried out (step 4), and when the copying is finished, the operation returns to the step 2, where idling is carried out until copy button is turned on next time.

Warm-Up

With reference to FIG. 14, the operation at the time of warm-up will be explained.

The control section 500 receives the temperature information (t1) from the first temperature detecting means 330; if the temperature of the heating roller 91 is lower than the first set temperature (T1), the first halogen heater lamp 210 is driven until it reaches or exceeds the first set temperature (T1) (steps 1 and 2), and if the temperature of the heating roller 91 is equal to or higher than the first set temperature (T1), the driving of the first heater lamp 210 is stopped (step 3), and the warm-up (WU) finish flag 1 is turned on (step 4).

Further, the control section 500 receives the temperature information (t2) from the second temperature detecting means 340; if the temperature of the heating roller 91 is lower than the first set temperature (T2), the second halogen heater lamp 220 is driven until it reaches or exceeds the first set temperature (T2) (steps 5 and 6), and if the temperature of the heating roller 91 is equal to or higher than the first set temperature (T2), the driving of the second heater lamp 220 is stopped (step 7), and the warm-up (WU) finish flag 2 is turned on (step 8).

Then, the step 1–step 6 are practiced repeatedly until the WU finish flag 1 and the WU finish flag 2 are both turned on, and when the WU finish flag 1 and the WU finish flag 2 have been both turned on, the operation is finished (step 9).

Idling

With reference to FIG. 15, the operation at the time of idling will be explained.

When the WU finish flag 1 and the WU finish flag 2 have been both turned on, the control section 500 watches if the first halogen lamp 210 is driven (step 1); if it is driven, the control section receives the temperature information (t1) from the first temperature detecting means 330; if it is lower than the second set temperature (T1'), the driving of the first halogen heater lamp 210 is continued, and if it is equal to or higher than the second set temperature (T1'), the driving of the first halogen heater lamp 210 is stopped (steps 2 and 3).

Further, in the step 1, if the driving of the first halogen heater lamp 210 is stopped, the control section receives the temperature information (t1) from the first temperature detecting means 330; if it is equal to or higher than the third set temperature (T1"), the stop of driving of the first halogen heater lamp 210 is continued, and if it is lower than the third set temperature (T1"), the first halogen heater lamp 210 is driven (steps 4 and 5).

In addition, the second set temperature (Ti')>the third set temperature (T1"). In this example of the embodiment, T1'=191° C., and T1"=187° C.

Next, the control section watches whether the second halogen heater lamp 220 is driven or not (step 6), and if it is driven, the control section receives the temperature information (t2) from the second temperature detecting means 340; if it is lower than the second set temperature (T2'), the driving of the second halogen heater lamp 220 is continued, and if it is equal to or higher than the second set temperature (T2'), the driving of the second halogen heater lamp is stopped (steps 7 and 8).

Further, in the step 6, if the driving of the second halogen heater lamp 210 is stopped, the control section receives the temperature information (t2) from the second temperature detecting means 340; if it is equal to or higher than the third set temperature (T2"), the stop of driving of the second halogen heater lamp 220 is continued, and if it is lower than the third set temperature (T1"), the second halogen heater lamp 220 is driven (steps 9 and 10).

In addition, the second set temperature (T2')>the third set temperature (T2"). In this example of the embodiment, T2'=191° C., and T2"=187° C.

That is, in the fixing apparatus of this example of the embodiment, the temperature control of the heating roller 91 during idling makes two-position operation having so-called 'differential gap'.

Copying

In idling hours, when an operator inputs the recording paper size information (w) and the number of copy information (I) to the apparatus, and turns on the copy button, copying is started.

With reference to FIG. 16 and FIG. 17, the operation at the time of copying will be explained.

The control section 500 reads the recording paper size information (w) and the number of copy information (I) (step 1), drives the heating roller, and carries out the fixing of set number of copies.

At this time, the control operation is remarkably different between the case where the width (w) in the size of the recording paper P to be fed is larger than the predetermined size (W) (sizes equal to or larger than A4R in this example of the embodiment), and the case where it is equal to or smaller than the predetermined size (W) (sizes A5R, B5R, B6R, and 5.5×8.5R) (step 2).

If the size (w) of the recording paper P to be fed is larger than the predetermined size (W), the cooling fan 350 is not driven (steps 2 and 3), and until the copying is finished, the fixing temperature control (the fourth set temperature (T1'": 194° C. in this example of the embodiment) in the area L1 and the fourth set temperature (T2'": 194° C. in this example of the embodiment) in the area L2 of the heating roller 91) is carried out (steps 4 and 5).

When copying is finished, the driving for rotation of the heating roller 91 is stopped, and the driving of the first and second halogen heater lamps 210 and 220 is stopped (step 6).

On the other hand, in the step 2, if the size (w) of the recording paper P is equal to or smaller than the predetermined size (W), the cooling fan 350 is driven (step 7).

In the case where the copy count is 10 or less, the temperature control (the fourth set temperature (T1'": 184° C.) in the area L1 and the fourth set temperature (T2'": 194° C.) in the area L2 of the heating roller 91) is carried out (steps 8 and 9).

If the copy count exceeds 10, the temperature control (the fourth set temperature (T1'''): 184° C.) in the area L1 and the third set temperature (T2'''): 189° C.) in the area L2 of the heating roller 91) is carried out (steps 8 and 10).

When copying is finished, the cooling fan 350 is stopped (step 11), and the driving of the first and second halogen heater lamps 210 and 220 is stopped (step 6).

In the following, with reference to FIG. 17, the fixing temperature control during the above-described copying operation will be explained.

The control section 500 receives the temperature information (t1) from the first temperature detecting means 330; if it is lower than the fourth set temperature (T1'''), the first halogen heater lamp 210 is driven (steps 1 and 2), and if it is equal to or higher than the fourth set temperature (T1'''), the driving of the first halogen heater lamp 210 is stopped (steps 1 and 3).

Next, the control section receives the temperature information (t2) from the second temperature detecting means 340; if it is lower than the fourth set temperature (T2'''), the second halogen heater lamp 220 is driven (steps 4 and 5), and if it is equal to or higher than the fourth set temperature (T2'''), the driving of the second halogen heater lamp 220 is stopped (steps 4 and 6).

According to the above-described structure and the method of control, the effects as described below can be obtained.

(1) When fixing is finished and the driving for rotation of the heating roller is stopped, the control section 500 always stops the driving of the first halogen heater lamp 210 and the second halogen heater lamp 220; thus the overshoot immediately after stopping can be prevented by it, and useless consumption of electric power is eliminated.

(2) In the case where a sheet of recording paper P having a width narrower than the predetermined size is subjected to fixing, the control section 500 drives the cooling fan 350 as a cooling means (FIG. 7: step 7).

Further, it makes the set temperature in the first halogen heater lamp 210 decrease (FIG. 7: steps 9 and 10: the second and third set temperature T1' and T1" (187° C.–191° C.)←the fourth set temperature T1''' (184° C.)).

Further, it makes the set temperature in the second halogen heater lamp 220 rise up to 10 copies (FIG. 7: steps 9: the second and third set temperature T2' and T2" (187° C. –191° C.)←the fourth set temperature T2''' (194° C.)), and decrease on and after 11 copies (194° C.←189° C.).

Accordingly, the precision of the temperature control in the case of the fixing for the recording paper P having a narrow width is made high.

(3) During idling, the control section 500 carries out a control such that the temperature falls within the range from 187° C. to 191° C., that is, a control having an differential gap; therefore, the frequency of turning on and off of the first and second halogen heater lamps 210 and 220 is reduced and the generation of a noise is suppressed.

According to this invention, the electric power consumption in the fixing apparatus during image formation is approximately determined by the product of the heat quantity required for fixing a sheet of transfer material times the number of sheets having an image formed.

In an image forming apparatus of a class with an image forming speed of 20–30 sheets per minute, the heat quantity required for a unit time is small in proportion to the slow speed of image forming, and it is not necessary to store heat in the heating roller; thus, sufficient heat can be supplied at the time of image forming.

Accordingly, it is desirable to make the sleeve of the heating roller as thin as possible.

By making the material of the sleeve of the heating roller either aluminum or iron and the thickness of the sleeve equal to or smaller than 2.0 mm, that is, by making it thin, the heat capacity of the heating roller is made small, which makes the thermal efficiency high.

Further, by making the material of the pressing roller a silicone rubber, its surface hardness (Asker C hardness) 35–75, the nip pressure between said heating roller and said pressing roller 0.2–2.0 kgf/cm$^2$, and the nip passing time 20–40 msec, that is, by making the pressing roller of a soft material, the nip time of a transfer material is made long, and the heat quantity to be supplied to the transfer material can be secured.

According to this invention, by providing a first heating means for heating the area which is inside the area which a sheet of transfer material of the maximum size passes and is outside the area which a sheet of transfer material of a predetermined size passes, and a second heating means for heating the area which a sheet of transfer material of the predetermined size passes, and independently controlling the driving of the first heating means and the second heating means, even in the case where a sheet of transfer material having a size equal to or smaller than a predetermined size is fixed, it can be prevented the temperature rise of the portion which no sheet of paper comes in contact with and is inside the area which a sheet of transfer material of the maximum size passes and is outside the area which a sheet of transfer material of the predetermined size passes; thus, the useless area is not heated and the electric power consumption of the heating means is reduced.

According to this invention, the heat distribution ratio in the first heating means are equal to or larger than 15% for the area which a sheet of transfer material of the predetermined size passes on condition that it is 100% for the area outside the area which a sheet of transfer material of the predetermined size passes.

By making such a heat distribution ratio, by turning the first heating means on and off during idling, even if the second heating means is in the off-state, the temperature over the whole area of the heating roller can be kept approximately uniform.

Thus, the number of times of turning on and off of the heating means can be reduced, and the generation of a noise can be prevented.

According to this invention, the heat distribution ratio in the second heating means is equal to or smaller than 60% for the area outside the area which a sheet of transfer material of the predetermined size passes on condition that it is 100% for the area which a sheet of transfer material of the predetermined size passes.

By making such a heat distribution ratio, even when plural sheets of transfer material having a width smaller than the predetermined size are continuously fixed, the temperature of the heating roller can be kept at a predetermined temperature by only the second heating means.

According to this invention, by providing a first temperature detecting means for detecting the temperature of the area of the heating roller which is inside the area which a sheet of transfer material of the maximum size passes and is outside the area which a sheet of transfer material of the predetermined size passes, and a second temperature detecting means for detecting the temperature of the area of said heating roller which a sheet of transfer material of the predetermined size passes, a precise temperature control for the first heating means and the second heating means can be done, and the electric power consumption is reduced.

In the case where the formation of an image is continuously carried out on a large number of sheets of transfer material having a width smaller than the predetermined size, the temperatures of the both side portions in the first heating means rise extremely; however, according to this invention, by providing a thermostat in the neighborhood of the border of the aforesaid first heating means and the aforesaid second heating means of the heating roller, it can be prevented that the heating roller reaches a temperature higher than the set temperature by cutting the supply of the electric power to the first heating means by the thermostat, and further, the electric power consumption is reduced.

According to this invention, by providing a cooling means for cooling the both side portions of the area of the heating roller which a sheet of transfer material of the predetermined size passes, in the case where the formation of an image is carried out on sheets of transfer material having a width smaller than the predetermined size, when the temperatures of the both side portions in the second heating means rise extremely, it can be prevented by cooling the heating roller by the cooling means that the heating roller reaches a temperature higher than the set temperature.

According to this invention, because only the web having a small heat capacity of the cleaning mechanism is in contact with the heating roller, the electric power consumption is small.

According to this invention, when fixing is finished and the driving for the rotation of the aforesaid heating roller is stopped, the control section stops the driving of the aforesaid heating means; therefore, useless consumption of electric power is eliminated.

According to this invention, in the case where sheets of transfer material having a narrower width than the predetermined size are fixed, the control section drives the aforesaid cooling means, and lowered the set temperature of the aforesaid first heating means and lowered also the set temperature of the aforesaid second heating means after the predetermined number of copies; therefore, the temperature control in the case where the transfer material having a narrower width than the predetermined size is fixed is made precise.

According to this invention, during idling, when the heating roller reaches or exceeds the first set temperature, the control section stops the aforesaid heating means, and when said heating roller comes to or below the second set temperature which is lower than said first set temperature, it drives said heating means, that is, it makes a control having an differential gap; therefore, the frequency of turning on and off of the heating means is reduced, and the generation of a noise is suppressed.

Of course, the disclosed embodiments can be varied by skilled persons without departing from the spirit and scope of the invention.

What is claimed is:

1. A fixing apparatus for fixing a toner image onto a transfer material, comprising:

a hollow cylindrical heating roller that has a thickness less than 2.0 mm, and that is made of at least one of aluminum and iron;

a heat source positioned inside said heating roller;

a pressing roller that comprises silicone rubber having a surface hardness ranging from 35° to 75° (Asker C hardness), and that is in pressure contact with said heating roller to form a nip between said heating roller and said pressing roller, wherein a nip pressure at said nip is in a range of 0.2–2.0 kgf/cm$^2$; and a controller that controls a conveyance velocity of said transfer material, so that said transfer material passes through said nip within a nip passing time ranging from 20 msec to 40 msec;

wherein, in a longitudinal direction of said heating roller, a region through which a transfer material of a predetermined size, except a transfer material having a maximum width, passes is defined as a second region, while another region through which said transfer material having said maximum width passes is defined as a first region outside said second region;

wherein said heat source comprises a first heating section to mainly heat said first region, and a second heating section to mainly heat said second region; and wherein a heat distribution ratio of said first heating section is set so that a heat quantity at said second region is in a range of 15%–70% of a heat quantity at said first region.

2. The fixing apparatus of claim 1, wherein during an idling state of said fixing apparatus when said fixing apparatus is standing by for a next fixing operation, said first heating section is either activated or deactivated, while said second heating section is deactivated.

3. The fixing apparatus of claim 1, further comprising:

a first temperature detector to detect a temperature of said heating roller at said first region; and a second temperature detector to detect a temperature of said heating roller at said second region.

4. The fixing apparatus of claim 3, further comprising:

a cooling device to cool both ends of said second region on said heating roller, and wherein said controller activates said cooling device and lowers a set temperature of said first heating section when fixing said toner image on a transfer material having a width shorter than said predetermined size.

5. The fixing apparatus of claim 4, wherein said controller lowers a set temperature of said second heating section when a number of transfer materials on which images are consecutively formed reaches a predetermined number.

6. The fixing apparatus of claim 1, further comprising:

a cleaning mechanism, having a cleaning web, to rub a surface of said heating roller with said cleaning web.

7. The fixing apparatus of claim 1, wherein said controller forcibly deactivates a heating action of said heat source when said controller deactivates a conveying action of said transfer material after fixing said toner image on said transfer material, and then controls a driving action of said heat source during an idling state of said fixing apparatus.

8. The fixing apparatus of claim 1, further comprising:

a thermostat disposed at a boundary area between said first region and said second region on said heating roller.

9. The fixing apparatus of claim 1, further comprising:

a cooling device to cool both ends of said second region on said heating roller.

10. The fixing apparatus of claim 1, further comprising:

a temperature detector to detect a temperature of said heating roller, and wherein during an idling state of said fixing apparatus when said fixing apparatus is standing by for a next fixing operation, said controller deactivates a heating action of said heat source when said controller determines that said temperature detected by said temperature detector is greater than a first set temperature, and then said controller reactivates the heating action of said heat source when said controller determines that said temperature detected by said temperature detector is lower than a second set temperature.

11. A fixing apparatus for fixing a toner image onto a transfer material, comprising:

a hollow cylindrical heating roller that has a thickness less than 2.0 mm, and that is made of at least one of aluminum and iron;

a heat source positioned inside said heating roller;

a pressing roller that comprises silicone rubber having a surface hardness ranging from 35° to 75° (Asker C hardness), and that is in pressure contact with said heating roller to form a nip between said heating roller and said pressing roller, wherein a nip pressure at said nip is in a range of 0.2–2.0 kgf/cm$^2$; and a controller that controls a conveyance velocity of said transfer material, so that said transfer material passes through said nip within a nip passing time ranging from 20 msec to 40 msec;

wherein, in a longitudinal direction of said heating roller, a region through which a transfer material of a predetermined size, except a transfer material having a maximum width, passes is defined as a second region, while another region through which said transfer material having said maximum width passes is defined as a first region outside said second region;

wherein said heat source comprises a first heating section to mainly heat said first region, and a second heating section to mainly heat said second region; and wherein a heat distribution ratio of said second heating section is set so that a heat quantity at said first region is lower than 60% of a heat quantity at said second region.

12. An image forming apparatus comprising:

an image bearing element on which a latent image is formed;

a developing device that forms a toner image on said image bearing element;

a transferring device that transfers said toner image onto a transfer material; and a fixing device that fixes said transferred toner image onto said transfer material, wherein said fixing device comprises:

a hollow cylindrical heating roller that has a thickness less than 2.0 mm, and that is made of at least one of aluminum and iron;

a heat source positioned inside said heating roller;

a pressing roller that comprises silicone rubber having a surface hardness ranging from 35° to 75° (Asker C hardness), and that is in pressure contact with said heating roller to form a nip between said heating roller and said pressing roller, wherein a nip pressure at said nip is in a range of 0.2–2.0 kgf/cm$^2$; and a controller that controls a conveyance velocity of said transfer material, so that said transfer material passes through said nip within a nip passing time ranging from 20 msec to 40 msec;

wherein, in a longitudinal direction of said heating roller, a region through which a transfer material of a predetermined size, except a transfer material having a maximum width, passes is defined as a second region, while another region through which said transfer material having said maximum width passes is defined as a first region outside said second region;

wherein said heat source of said fixing device comprises a first heating section to mainly heat said first region, and a second heating section to mainly heat said second region; and wherein a heat distribution ratio of said first heating section is set so that a heat quantity at said second region is in a range of 15%–70% of a heat quantity at said first region.

13. The image forming apparatus of claim 12, wherein during an idling state of said fixing device when said fixing device is standing by for a next fixing operation, said first heating section is either activated or deactivated, while said second heating section is deactivated.

14. The image forming apparatus of claim 12, wherein a heat distribution ratio of said second heating section is set so that a heat quantity outside of said second region is lower than 60% of a heat quantity at said second region.

* * * * *